US008994225B2

(12) United States Patent
Hong et al.

(10) Patent No.: US 8,994,225 B2
(45) Date of Patent: Mar. 31, 2015

(54) WIRELESS POWER TRANSMISSION SYSTEM AND RESONATOR FOR THE SYSTEM

(75) Inventors: Young Tack Hong, Yongin-si (KR); Jung Hae Lee, Yongin-si (KR); Sang Wook Kwon, Yongin-si (KR); Eun Seok Park, Yongin-si (KR); Jae Hyun Park, Yongin-si (KR); Byung Chul Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 695 days.

(21) Appl. No.: 13/382,163

(22) PCT Filed: Jul. 6, 2010

(86) PCT No.: PCT/KR2010/004394

§ 371 (c)(1), (2), (4) Date: Apr. 17, 2012

(87) PCT Pub. No.: WO2011/005012

PCT Pub. Date: Jan. 13, 2011

(65) Prior Publication Data

US 2012/0193997 A1 Aug. 2, 2012

(30) Foreign Application Priority Data

Jul. 6, 2009 (KR) ..... 10-2009-0060984

(51) Int. Cl.

| | |
|---|---|
| ***H01F 27/42*** | (2006.01) |
| ***H01P 7/08*** | (2006.01) |
| ***H01Q 7/00*** | (2006.01) |

(52) U.S. Cl.
CPC . *H01P 7/08* (2013.01); *H01Q 7/005* (2013.01)
USPC ..... 307/104

(58) Field of Classification Search
USPC ..... 307/104
See application file for complete search history.

(56) References Cited

U.S. PATENT DOCUMENTS

| | | | |
|---|---|---|---|
| 4,749,963 | A | 6/1988 | Makimoto et al. |
| 5,057,803 | A | 10/1991 | Ooi et al. |
| 2005/0146402 | A1 | 7/2005 | Sarabandi et al. |
| 2005/0237131 | A1 | 10/2005 | Chang et al. |
| 2007/0120629 | A1 | 5/2007 | Schnell et al. |
| 2008/0164960 | A1 | 7/2008 | Schnell et al. |
| 2009/0140946 | A1 | 6/2009 | Ziolkowski et al. |

(Continued)

FOREIGN PATENT DOCUMENTS

| | | | |
|---|---|---|---|
| EP | 1 962 367 | A1 | 8/2008 |
| JP | 04-134911 | A | 5/1992 |
| JP | 2000-172795 | A | 6/2000 |

(Continued)

OTHER PUBLICATIONS

European Search Report issued Dec. 17, 2012 in counterpart European Patent Application No. 10797286.1 (9 pages, in English).

(Continued)

*Primary Examiner* — Robert L. Deberadinis
(74) *Attorney, Agent, or Firm* — NSIP Law

(57) ABSTRACT

Provided is a wireless power resonator. The wireless power resonator, including a transmission line and a capacitor, may form a loop structure, and may additionally include a matcher to determine an impedance of the wireless power resonator.

16 Claims, 22 Drawing Sheets

(56) References Cited

U.S. PATENT DOCUMENTS

| | | | | |
|---|---|---|---|---|
| 2012/0217820 | A1* | 8/2012 | Hong et al. | 307/104 |
| 2014/0028112 | A1* | 1/2014 | Hui et al. | 307/104 |

FOREIGN PATENT DOCUMENTS

| | | | |
|---|---|---|---|
| JP | 2004-126750 | A | 4/2004 |
| JP | 2006-523405 | A | 10/2006 |
| JP | 2006-311306 | A | 11/2006 |
| JP | 2008-301241 | A | 12/2008 |
| KR | 10-2005-0110430 | A | 11/2005 |
| WO | WO 2004/034504 | A1 | 4/2004 |
| WO | WO 2008-030021 | A1 | 3/2008 |
| WO | WO 2009/081662 | A1 | 7/2009 |

OTHER PUBLICATIONS

Japanese Office Action issued May 20, 2014 in counterpart Japanese Patent Application No. 2012-519468 (7 pages in Japanese).

Chinese Office Action issued Sep. 26, 2013 in counterpart Chinese Patent Application No. 201080039712.4 (10 pages in Chinese).

International Search Report issued on Feb. 23, 2011 in counterpart International Application No. PCT/KR2010/004394 (5 pages including English translation).

* cited by examiner $$W_{MZR} = \frac{1}{\sqrt{L_R C_L}}$$

| | MNG RESONATOR FOR WIRELESS POWER TRANSMISSION |
|---|---|
| TYPE OF DOMINANT FIELD IN NEAR FIELD | MAGNETIC FIELD |
| MAJOR PROPERTY | MAGNETIC FIELD COUPLING |
| STRUCTURE | 3D |
| Q-FACTOR | AIM FOR HIGH Q |
| PURPOSES | WIRELESS POWER TRANSMISSION IN SHORT DISTANCE |

WIRELESS POWER TRANSMISSION SYSTEM AND RESONATOR FOR THE SYSTEM

CROSS REFERENCE TO RELATED APPLICATIONS:

This application is a U.S. national stage application under 35 USC 371 of International Application No. PCT/KR2010/004394 filed on Jul. 6, 2010, which claims the benefit of Korean Application No. KR 10-2009-0060984 filed on Jul. 6, 2009, in the Korean Intellectual Property Office, the entire disclosures of which are incorporated herein by reference for all purposes.

TECHNICAL FIELD

The following description relates to a wireless power transmission system, and more particularly, to a method for designing a resonator for a wireless power transmission system.

BACKGROUND ART

One of the wireless power transmission technologies may use a resonance characteristic of radio frequency (RF) devices. A resonator using a coil structure may require a change in a physical size based on a frequency.

DISCLOSURE OF INVENTION

In one general aspect, there is provided a wireless power resonator, including at least two unit resonators, and each unit resonator includes a transmission line including a first signal conducting portion, a second signal conducting portion, and a ground conducting portion corresponding to the first signal conducting portion and the second signal conducting portion, a first conductor that electrically connects the first signal conducting portion and the ground conducting portion, a second conductor that electrically connects the second signal conducting portion and the ground conducting portion, and at least one capacitor inserted between the first signal conducting portion and the second signal conducting portion in series with respect to a current flowing through the first signal conducting portion and the second signal conducting portion.

The transmission line, the first conductor, the second conductor may form a loop structure.

The at least two unit resonators may include a first unit resonator and a second unit resonator, the first unit resonator may be disposed on an upper plane and the second unit resonator is disposed on a lower plane, and the upper plane and the lower plane may be disposed at a predetermined distance away from each other.

An external circumference of the first unit resonator may be equal to an external circumference of the second unit resonator, and an area of an internal loop of the first unit resonator may be equal to an area of an internal loop of the second unit resonator.

A capacitor inserted into the first unit resonator may be disposed in an opposite direction to a direction in which a capacitor inserted into the second unit resonator is disposed.

The second unit resonator may be included in a loop of the first unit resonator.

The wireless power resonator may further include a matcher, disposed inside a loop formed by the transmission line, the first conductor, and the second conductor, to determine an impedance of the wireless power resonator.

In another general aspect, there is provided a wireless power resonator, including a transmission line including a first signal conducting portion, a second signal conducting portion, a ground conducting portion corresponding to the first signal conducting portion and the second signal conducting portion, a first conductor that electrically connects the first signal conducting portion and the ground conducting portion, a second conductor that electrically connects the second signal conducting portion and the ground conducting portion, and at least one capacitor inserted between the first signal conducting portion and the second signal conducting portion in series with respect to a current flowing through the first signal conducting portion and the second signal conducting portion, and the first signal conducting portion, the second signal conducting portion, the first conductor, and the second conductor form a plurality of turns.

The plurality of turns included in at least one transmission line may be disposed in the same plane.

The wireless power resonator may further include a matcher, disposed inside a loop formed by the transmission line, the first conductor, and the second conductor.

In still another general aspect, there is provided a wireless power resonator, including a first unit resonator and at least one second unit resonator having a size less than a size of the first unit resonator, and each resonance unit includes a transmission line including a first signal conducting portion, a second signal conducting portion, and a ground conducting portion corresponding to the first signal conducting portion and the second signal conducting portion, a first conductor that electrically connects the first signal conducting portion and the ground conducting portion, a second conductor that electrically connects the second signal conducting portion and the ground conducting portion, and at least one capacitor inserted between the first signal conducting portion and the second signal conducting portion in series with respect to a current flowing through the first signal conducting portion and the second signal conducting portion, and the at least one second unit resonator is disposed inside a loop of the first unit resonator.

The at least one second unit resonator may be disposed inside the loop of the first unit resonator at regular intervals.

Each unit resonator may further include a matcher that is disposed inside the loop formed by the transmission line, the first conductor, and the second conductor so as to determine an impedance of the wireless power resonator.

In yet another general aspect, there is provided a wireless power resonator, including at least two unit resonators forming magnetic fields in different directions, and each unit resonator includes a transmission line including a first signal conducting portion, a second signal conducting portion, and a ground conducting portion corresponding to the first signal conducting portion and the second signal conducting portion, a first conductor that electrically connects the first signal conducting portion and the ground conducting portion, a second conductor that electrically connects the second signal conducting portion and the ground conducting portion, and at least one capacitor inserted between the first signal conducting portion and the second signal conducting portion in series with respect to a current flowing through the first signal conducting portion and the second signal conducting portion.

The at least two unit resonators may be disposed to enable magnetic fields formed by the at least two unit resonators to be orthogonal to each other.

The current may flow through at least one resonator selected from among the at least two unit resonators.

BEST MODE FOR CARRYING OUT THE INVENTION

The following detailed description is provided to assist the reader in gaining a comprehensive understanding of the methods, apparatuses and/or systems described herein. Accordingly, various changes, modifications, and equivalents of the systems, apparatuses and/or methods described herein may be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of well-known functions and constructions may be omitted for increased clarity and conciseness.

Figure 1:
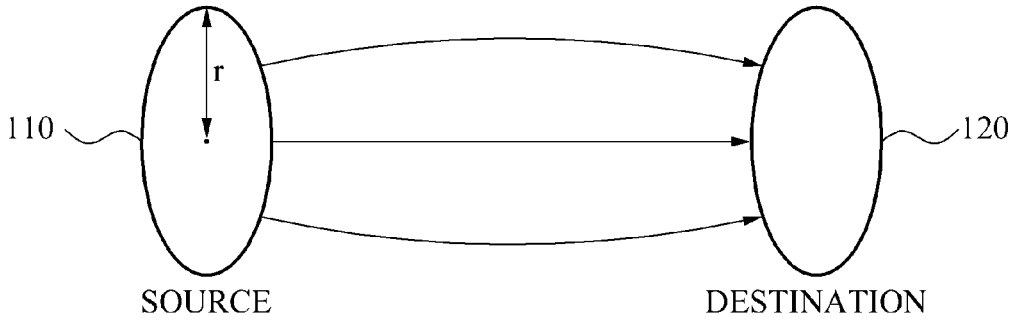
FIG. 1 is a diagram illustrating an example of a wireless power transmission system including resonators for wireless power transmission.

FIG. 1 illustrates an example of a wireless power transmission system, including a resonator for wireless power transmission and a resonator for wireless power reception.

The wireless power transmission system using a resonance characteristic of FIG. 1 may include a source 110 and a destination 120. Here, the source 110 may wirelessly provide power to the destination 120 using a resonator configured as a helix coil structure or a resonator configured as a spiral coil structure.

Here, physical sizes of the resonator configured as the helix coil structure or the resonator configured as the spiral coil structure may be dependent upon a desired resonant frequency. For example, when the desired resonant frequency is 10 megahertz (Mhz), a diameter of the resonator configured as the helix coil structure may be determined to be about 0.6 meters (m), and a diameter of the resonator configured as the spiral coil structure may be determined to be about 0.6 m. In this example, as a desired resonant frequency decreases the diameter of the resonator configured as the helix coil structure and the diameter of the resonator configured as the spiral coil structure may need to be increased.

The change occurs in a physical size of a resonator due to a change in a resonant frequency is not exemplary. As an extreme example, when a resonant frequency is significantly low, a size of the resonator may be remarkably large, which may not be practical. When the resonant frequency is independent of the size of the resonant, the resonator may be exemplary. Also, a resonator that has a rational physical size and operates well irrespective of a high resonant frequency and a low resonant frequency may be an exemplary resonator.

Hereinafter, related terms will be described for concise understanding although the terms are well known. All the materials may have a unique magnetic permeability, that is, Mu, and a unique permittivity, that is, epsilon. The magnetic permeability indicates a ratio between a magnetic flux density occurring with respect to a given magnetic field in a corresponding material and a magnetic flux density occurring with respect to the given magnetic field in a vacuum state. The permittivity indicates a ratio between an electric flux density occurring with respect to a given electric field in a corresponding material and an electric flux density occurring with respect to the given electric field in a vacuum state. The magnetic permeability and the permittivity may determine a propagation constant of a corresponding material in a given frequency or a given wavelength. An electromagnetic characteristic of the corresponding material may be determined based on the magnetic permeability and the permittivity. In particular, a material having a magnetic permeability or a permittivity not found in nature and being artificially designed is referred to as a metamaterial. The metamaterial may be easily disposed in a resonance state even in a relatively large wavelength area or a relatively low frequency area. For example, even though a material size rarely varies, the metamaterial may be easily disposed in the resonance state.

Figure 2:
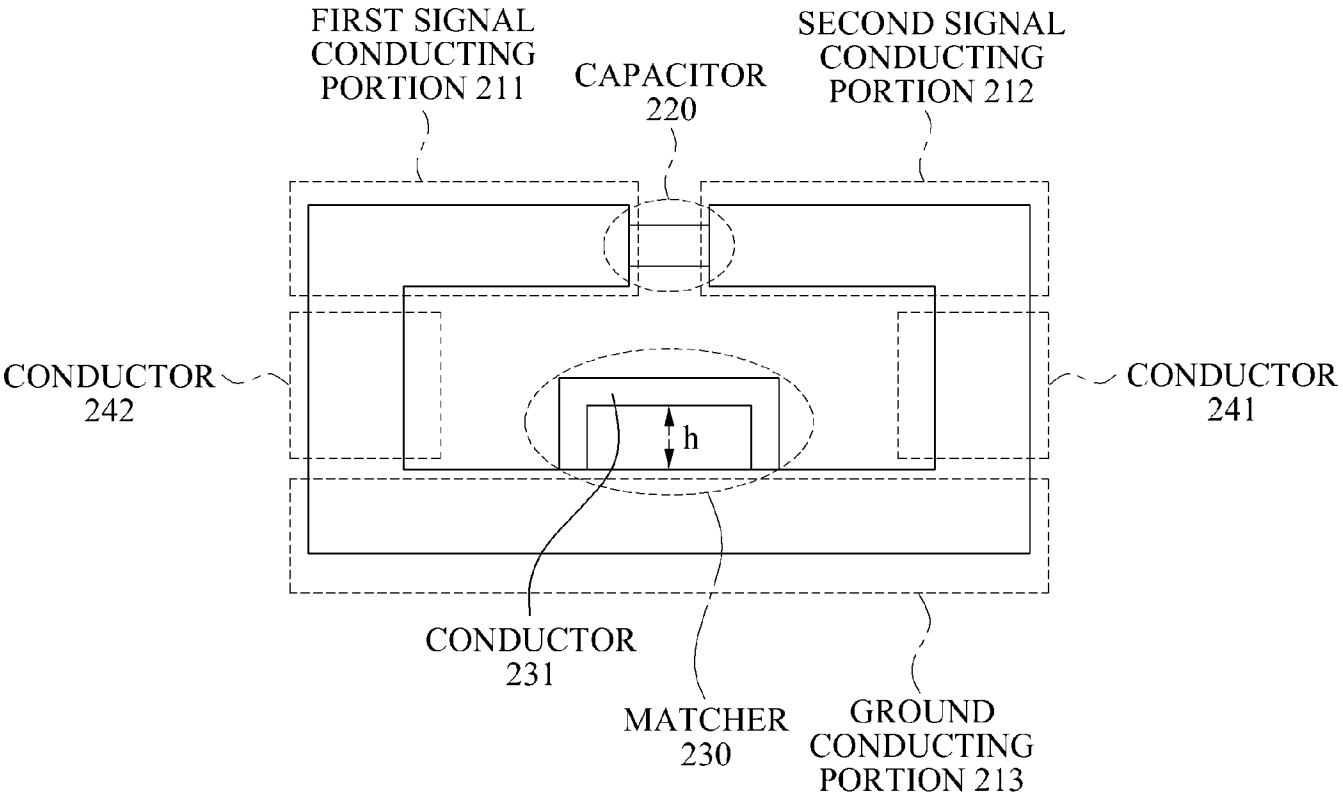
FIG. 2 is a diagram illustrating an example of a resonator having a two-dimensional (2D) structure.

FIG. 2 illustrates an example of a resonator having a 2D structure.

Referring to FIG. 2, the resonator having the 2D structure includes a transmission line, a capacitor 220, a matcher 220, and conductors 241 and 242. The transmission line includes a first signal conducting portion 211, a second signal conducting portion 212, and a ground conducting portion 213.

The capacitor 220 may be inserted in series between the first signal conducting portion 211 and the second signal conducting portion 212, whereby an electric field may be confined within the capacitor 220. Generally, the transmission line may include at least one conductor in an upper portion of the transmission line, and may also include at least one conductor in a lower portion of the transmission line. A current may flow through the at least one conductor disposed in the upper portion of the transmission line and the at least one conductor disposed in the lower portion of the transmission may be electrically grounded. Herein, a conductor disposed in an upper portion of the transmission line may be separated into and thereby be referred to as the first signal conducting portion 211 and the second signal conducting portion 212. A conductor disposed in the lower portion of the transmission line may be referred to as the ground conducting portion 213.

As shown in FIG. 2, the resonator 200 may have the 2D structure. The transmission line may include the first signal conducting portion 211 and the second signal conducting portion 212 in the upper portion of the transmission line, and may include the ground conducting portion 213 in the lower portion of the transmission line. The first signal conducting portion 211 and the second signal conducting portion 212 may be disposed to face the ground conducting portion 213. The current may flow through the first signal conducting portion 211 and the second signal conducting portion 212.

One end of the first signal conducting portion 211 may be shorted to a conductor 242, and another end of the first signal conducting portion 211 may be connected to the capacitor 220. One end of the second signal conducting portion 212 may be shorted to the conductor 241, and another end of the second signal conducting portion 212 may be connected to the capacitor 220. Accordingly, the first signal conducting portion 211, the second signal conducting portion 212, the ground conducting portion 213, and the conductors 241 and 242 may be connected to each other, whereby the resonator 200 may have an electrically closed-loop structure. The term "loop structure" may include a polygonal structure, for example, a circular structure, a rectangular structure, and the like. "Having a loop structure" may indicate being electrically closed.

The capacitor 220 may be inserted into an intermediate portion of the transmission line. Specifically, the capacitor 220 may be inserted into a space between the first signal conducting portion 211 and the second signal conducting portion 212. The capacitor 220 may have a shape of a lumped element, a distributed element, and the like. In particular, a distributed capacitor having the shape of the distributed element may include zigzagged conductor lines and a dielectric material having a relatively high permittivity between the zigzagged conductor lines.

When the capacitor 220 is inserted into the transmission line, the resonator 200 may have a property of a metamaterial. The metamaterial indicates a material having a predetermined electrical property that cannot be discovered in nature and thus, may have an artificially designed structure. An electromagnetic characteristic of all the materials existing in nature may have a unique magnetic permeability or a unique permittivity. Most materials may have a positive magnetic permeability or a positive permittivity. In the case of most materials, a right hand rule may be applied to an electric field, a magnetic field, and a pointing vector and thus, the corresponding materials may be referred to as right handed materials (RHMs). However, the metamaterial has a magnetic permeability or a permittivity absent in nature and thus, may be classified into an epsilon negative (ENG) material, a mu negative (MNG) material, a double negative (DNG) material, a negative refractive index (NRI) material, a left-handed (LH) material, and the like, based on a sign of the corresponding permittivity or magnetic permeability.

When a capacitance of the capacitor inserted as the lumped element is appropriately determined, the resonator 200 may have the characteristic of the metamaterial. Since the resonator 200 may have a negative magnetic permeability by appropriately adjusting the capacitance of the capacitor 220, the resonator 200 may also be referred to as an MNG resonator. Various criteria may be applied to determine the capacitance of the capacitor 220. For example, the various criteria may include a criterion for enabling the resonator 200 to have the characteristic of the metamaterial, a criterion for enabling the resonator 200 to have a negative magnetic permeability in a target frequency, a criterion for enabling the resonator 200 to have a zeroth-order resonance characteristic in the target frequency, and the like. Based on at least one criterion among the aforementioned criteria, the capacitance of the capacitor 220 may be determined.

The resonator 200, also referred to as the MNG resonator 200, may have a zeroth-order resonance characteristic of having, as a resonance frequency, a frequency when a propagation constant is "0". Since the resonator 200 may have the zeroth-order resonance characteristic, the resonance frequency may be independent with respect to a physical size of the MNG resonator 200. By appropriately designing the capacitor 220, the MNG resonator 200 may sufficiently change the resonance frequency. Accordingly, the physical size of the MNG resonator 200 may not be changed.

In a near field, the electric field may be concentrated on the capacitor 220 inserted into the transmission line. Accordingly, due to the capacitor 220, the magnetic field may become dominant in the near field. The MNG resonator 200 may have a relatively high Q-factor using the capacitor 220 of the lumped element and thus, it is possible to enhance an efficiency of power transmission. Here, the Q-factor indicates a level of an ohmic loss or a ratio of a reactance with respect to a resistance in the wireless power transmission. It can be understood that the efficiency of the wireless power transmission may increase according to an increase in the Q-factor.

The MNG resonator 200 may include the matcher 220 for impedance-matching. The matcher 220 may appropriately adjust a strength of a magnetic field of the MNG resonator 200. An impedance of the MNG resonator 200 may be determined by the matcher 220. A current may flow in the MNG resonator 200 via a connector, or may flow out from the MNG resonator 200 via the connector. The connector may be connected to the ground conducting portion 213 or the matcher 220. A physical connection may be formed between the connector and the ground conducting portion 213, or between the connector and the matcher 220. The power may be transferred through coupling without using a physical connection between the connector and the ground conducting portion 213 or the matcher 220.

More specifically, as shown in FIG. 2, the matcher 220 may be positioned within the loop formed by the loop structure of the resonator 200. The matcher 220 may adjust the impedance of the resonator 200 by changing the physical shape of the matcher 220. For example, the matcher 220 includes a conductor 231 for the impedance-matching in a location separate from the ground conducting portion 213 by a distance h. The impedance of the resonator 200 may be changed by adjusting the distance h.

Although not illustrated in FIG. 2, a controller may be provided to control the matcher 220. In this case, the matcher 220 may change the physical shape of the matcher 220 based on a control signal generated by the controller. For example, the distance h between a conductor 231 of the matcher 220 and the ground conducting portion 213 may increase or decrease based on the control signal. Accordingly, the physical shape of the matcher 220 may be changed whereby the impedance of the resonator 200 may be adjusted. The controller may generate the control signal based on varied factors, which will be described later.

As shown in FIG. 2, the matcher 220 may be configured as a passive element such as the conductor 231. Depending on embodiments, the matcher 220 may be configured as an active element such as a diode, a transistor, and the like. When the active element is included in the matcher 220, the active element may be driven based on the control signal generated by the controller, and the impedance of the resonator 200 may be adjusted based on the control signal. For example, a diode that is a type of the active element may be included in the matcher 220. The impedance of the resonator 200 may be adjusted depending on whether the diode is in an on state or in an off state.

Although not illustrated in FIG. 2, a magnetic core may be further provided to pass through the MNG resonator 200. The magnetic core may perform a function of increasing a power transmission distance.

Figure 3:
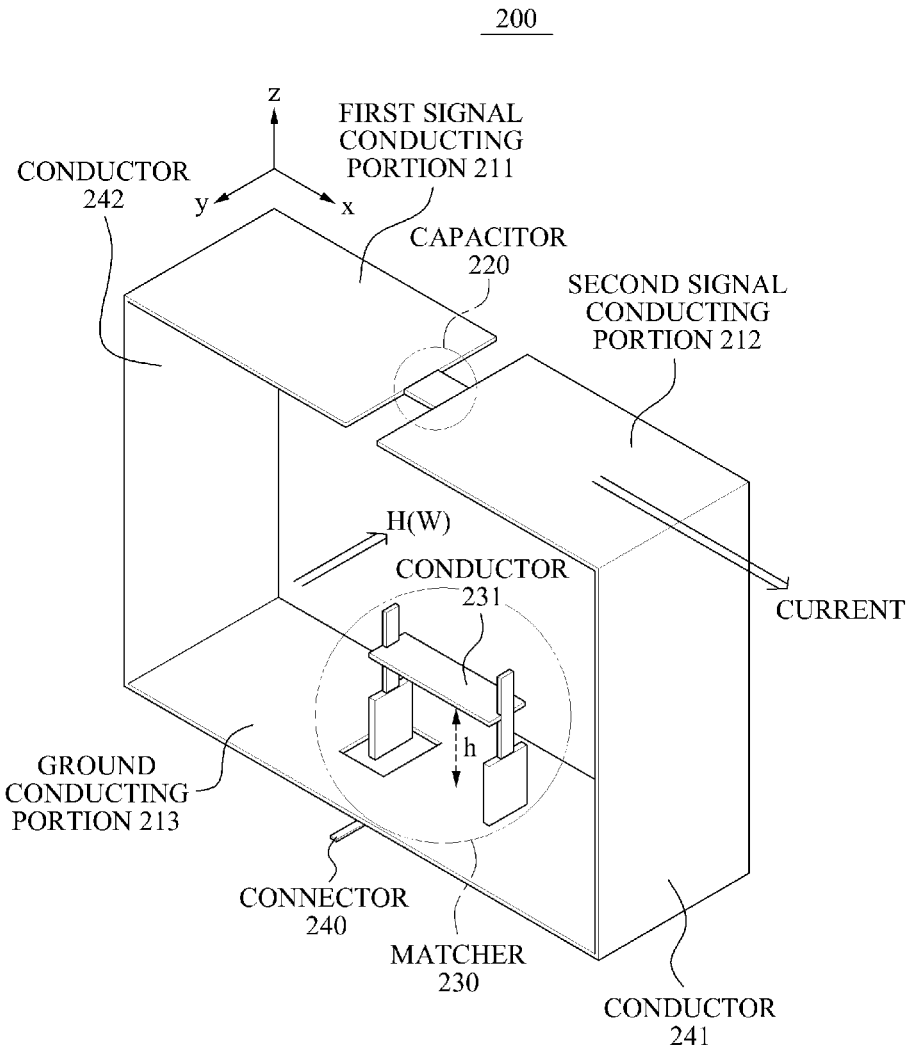
FIG. 3 is a diagram illustrating an example of a resonator having a three-dimensional (3D) structure.

FIG. 3 illustrates an example of a resonator having a 3D structure according to example embodiments.

Referring to FIG. 3, the resonator 200 having a 3D structure includes a transmission line and the capacitor 220. The transmission line includes the first signal conducting portion 211, the second signal conducting portion 212, and the ground conducting portion 213. The capacitor 220 may be inserted in series between the first signal conducting portion 211 and the second signal conducting portion 212 of the transmission line, whereby an electric field may be confined within the capacitor 220.

As shown in FIG. 3, the resonator 200 may have the 3D structure. The transmission line includes the first signal conducting portion 211 and the second signal conducting portion 212 in an upper portion of the resonator 200, and includes the ground conducting portion 213 in a lower portion of the resonator 200. The first signal conducting portion 211 and the second signal conducting portion 212 may be disposed to face the ground conducting portion 213. A current may flow in an x direction through the first signal conducting portion 211 and the second signal conducting portion 212. Due to the current, a magnetic field H(W) may be formed in a −y direction. Alternatively, unlike the diagram of FIG. 3, the magnetic field H(W) may be formed in a +y direction.

One end of the first signal conducting portion 211 may be shorted to the conductor 242, and another end of the first signal conducting portion 211 may be connected to the capacitor 220. One end of the second signal conducting portion 212 may be shorted to the conductor 241, and another end of the second signal conducting portion 212 may be connected to the capacitor 220. Accordingly, the first signal conducting portion 211, the second signal conducting portion 212, the ground conducting portion 213, and the conductors 241 and 242 may be connected to each other, whereby the resonator 200 may have an electrically closed-loop structure. The term "loop structure" may include a polygonal structure, for example, a circular structure, a rectangular structure, and the like. "Having a loop structure" may indicate being electrically closed.

As shown in FIG. 3, the capacitor 220 may be inserted into a space between the first signal conducting portion 211 and the second signal conducting portion 212. The capacitor 220 may have a shape of a lumped element, a distributed element, and the like. In particular, a distributed capacitor having the shape of the distributed element may include zigzagged conductor lines and a dielectric material having a relatively high permittivity between the zigzagged conductor lines.

As the capacitor 220 is inserted into the transmission line, the resonator 200 may have a property of a metamaterial. When a capacitance of the capacitor inserted as the lumped element is appropriately determined, the resonator 200 may have the characteristic of the metamaterial. Since the resonator 200 may have a negative magnetic permeability in a predetermined frequency band by appropriately adjusting the capacitance of the capacitor 220, the resonator 200 may also be referred to as an MNG resonator. Various criteria may be applied to determine the capacitance of the capacitor 220. For example, the various criteria may include a criterion for enabling the resonator 200 to have the characteristic of the metamaterial, a criterion for enabling the resonator 200 to have a negative magnetic permeability in a target frequency, a criterion for enabling the resonator 200 to have a zeroth-order resonance characteristic in the target frequency, and the like. Based on at least one criterion among the aforementioned criteria, the capacitance of the capacitor 220 may be determined.

The resonator 200, also referred to as the MNG resonator 200, may have a zeroth-order resonance characteristic of having, as a resonance frequency, a frequency when a propagation constant is "0". Since the resonator 200 may have the zeroth-order resonance characteristic, the resonance frequency may be independent with respect to a physical size of the MNG resonator 200. By appropriately designing the capacitor 220, the MNG resonator 200 may sufficiently change the resonance frequency. Accordingly, the physical size of the MNG resonator 200 may not be changed.

Referring to the MNG resonator 200 of FIG. 3, in a near field, the electric field may be concentrated on the capacitor 220 inserted into the transmission line. Accordingly, due to the capacitor 220, the magnetic field may become dominant in the near field. In particular, since the MNG resonator 200 having the zeroth-order resonance characteristic may have characteristics similar to a magnetic dipole, the magnetic field may become dominant in the near field. A relatively small amount of the electric field formed due to the insertion of the capacitor 220 may be concentrated on the capacitor 220 and thus, the magnetic field may become further dominant. The MNG resonator 200 may have a relatively high Q-factor using the capacitor 220 of the lumped element and thus, it is possible to enhance an efficiency of power transmission.

Also, the MNG resonator 200 includes a matcher 230 for impedance-matching. The matcher 230 may appropriately adjust the strength of magnetic field of the MNG resonator 200. An impedance of the MNG resonator 200 may be determined by the matcher 230. A current may flow in the MNG resonator 200 via a connector 240, or may flow out from the MNG resonator 200 via the connector 240. The connector 240 may be connected to the ground conducting portion 213 or the matcher 230.

More specifically, as shown in FIG. 3, the matcher 230 may be positioned within the loop formed by the loop structure of the resonator 200. The matcher 230 may adjust the impedance of the resonator 200 by changing the physical shape of the matcher 230. For example, the matcher 230 includes the conductor 231 for the impedance-matching in a location separate from the ground conducting portion 213 by a distance h. The impedance of the resonator 200 may be changed by adjusting the distance h.

Although not illustrated in FIG. 3, a controller may be provided to control the matcher 230. In this case, the matcher 230 may change the physical shape of the matcher 230 based on a control signal generated by the controller. For example, the distance h between the conductor 231 of the matcher 230 and the ground conducting portion 213 may increase or decrease based on the control signal. Accordingly, the physical shape of the matcher 230 may be changed whereby the impedance of the resonator 200 may be adjusted. The distance h between the conductor 231 of the matcher 230 and the ground conducting portion 213 may be adjusted using a variety of schemes. As one example, a plurality of conductors may be included in the matcher 230 and the distance h may be adjusted by adaptively activating one of the conductors. As another example, the distance h may be adjusted by adjusting the physical location of the conductor 231 up and down. The distance h may be controlled based on the control signal of the controller. The controller may generate the control signal using various factors. An example of the controller generating the control signal will be described later.

As shown in FIG. 3, the matcher 230 may be configured as a passive element such as the conductor 231. Depending on embodiments, the matcher 230 may be configured as an active element such as a diode, a transistor, and the like. When the active element is included in the matcher 230, the active element may be driven based on the control signal generated by the controller, and the impedance of the resonator 200 may be adjusted based on the control signal. For example, a diode that is a type of the active element may be included in the matcher 230. The impedance of the resonator 200 may be adjusted depending on whether the diode is in an on state or in an off state.

Although not illustrated in FIG. 3, a magnetic core may be further provided to pass through the resonator 200 configured as the MNG resonator. The magnetic core may perform a function of increasing a power transmission distance.

Figure 4:
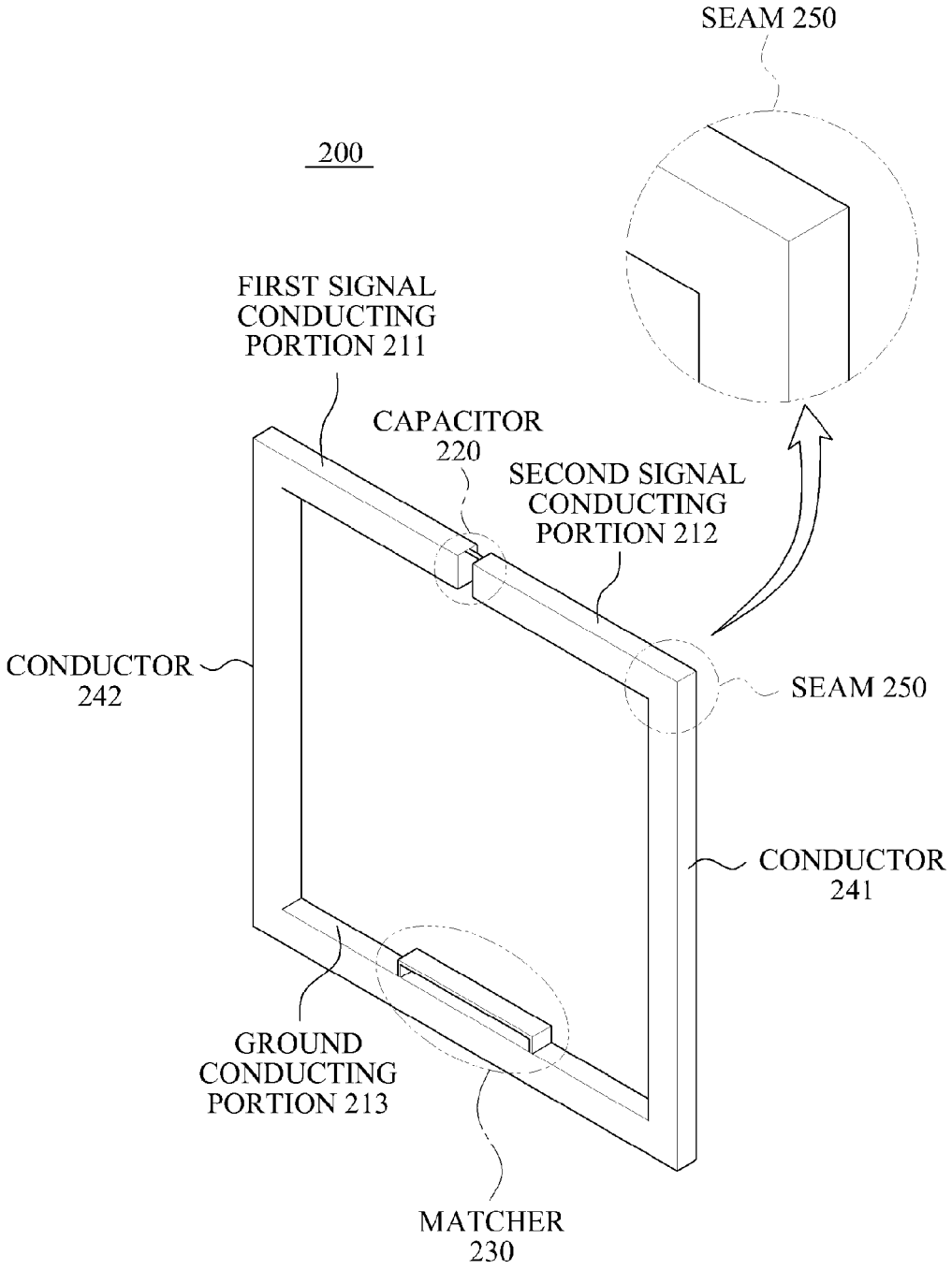
FIG. 4 is a diagram illustrating an example of a resonator for wireless power transmission configured as a bulk type.

FIG. 4 illustrates an example of a resonator for a wireless power transmission configured as a bulky type according to example embodiments.

Referring to FIG. 4, the first signal conducting portion 211 and the conductor 242 may be integrally formed instead of being separately manufactured and thereby be connected to each other. Similarly, the second signal conducting portion 212 and a conductor 241 may also be integrally manufactured.

When the second signal conducting portion 212 and the conductor 241 are separately manufactured and then are connected to each other, a loss of conduction may occur due to a seam 250. Accordingly, the second signal conducting portion 212 and the conductor 241 may be connected to each other without using a separate seam, that is, may be seamlessly connected to each other. Accordingly, it is possible to decrease a conductor loss caused by the seam 250. As another example, the second signal conducting portion 212 and the ground conducting portion 213 may be seamlessly and integrally manufactured. As another example, the first signal conducting portion 211 and the ground conducting portion 213 may be seamlessly and integrally manufactured. As another example, the first signal conducting portion 211 and the conductor 242 may be seamlessly manufactured. As another example, the conductor 242 and the ground conducting portion 213 may be seamlessly manufactured.

Referring to FIG. 4, a type of a seamless connection connecting at least two partitions into an integrated form is referred to as a bulky type.

Figure 5:
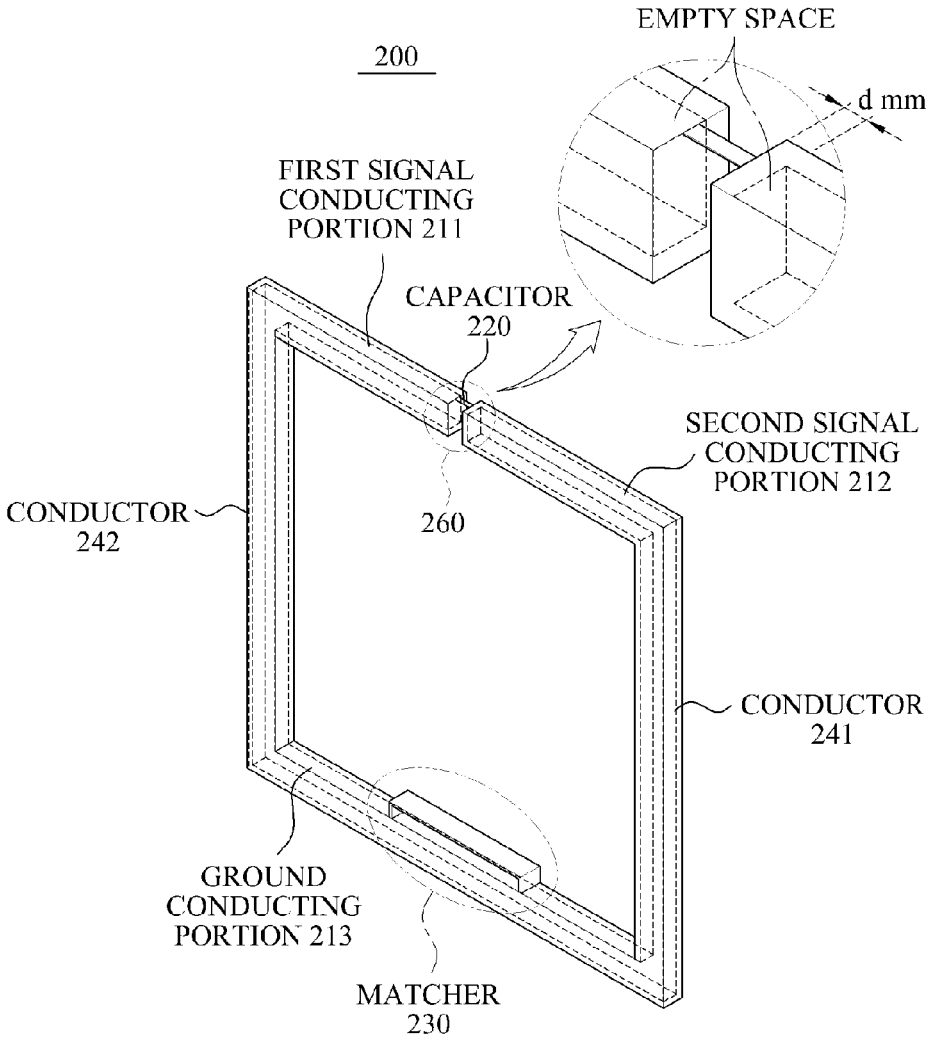
FIG. 5 is a diagram illustrating an example of a resonator for wireless power transmission configured as a hollow type.

FIG. 5 illustrates an example of a resonator for a wireless power transmission, configured as a hollow type according to example embodiments.

Referring to FIG. 5, each of the first signal conducting portion 211, the second signal conducting portion 212, the ground conducting portion 213, and conductors 241 and 242 of the resonator 200 configured as the hollow type includes an empty space inside.

In a given resonance frequency, an active current may be modeled to flow in only a portion of the first signal conducting portion 211 instead of all of the first signal conducting portion 211, the second signal conducting portion 212 instead of all of the second signal conducting portion 212, the ground conducting portion 213 instead of all of the ground conducting portion 213, and the conductors 241 and 242 instead of all of the conductors 241 and 242. Specifically, when a depth of each of the first signal conducting portion 211, the second signal conducting portion 212, the ground conducting portion 213, and the conductors 241 and 242 is significantly deeper than a corresponding skin depth in the given resonance frequency, it may be ineffective. The significantly deeper depth may increase a weight or manufacturing costs of the resonator 200.

Accordingly, in the given resonance frequency, the depth of each of the first signal conducting portion 211, the second signal conducting portion 212, the ground conducting portion 213, and the conductors 241 and 242 may be appropriately determined based on the corresponding skin depth of each of the first signal conducting portion 211, the second signal conducting portion 212, the ground conducting portion 213, and the conductors 241 and 242. When each of the first signal conducting portion 211, the second signal conducting portion 212, the ground conducting portion 213, and the conductors 241 and 242 has an appropriate depth deeper than a corresponding skin depth, the resonator 200 may become light, and manufacturing costs of the resonator 200 may also decrease.

For example, as shown in FIG. 5, the depth of the second signal conducting portion 212 may be determined as "d" mm and d may be determined according to $$d = \frac{1}{\sqrt{\pi f \mu \sigma}}.$$

Here, f denotes a frequency, μ denotes a magnetic permeability, and σ denotes a conductor constant. When the first signal conducting portion 211, the second signal conducting portion 212, the ground conducting portion 213, and the conductors 241 and 242 are made of a copper and have a conductivity of $5.8\times10^7$ siemens per meter ($S\cdot m^{-1}$), the skin depth may be about 0.6 mm with respect to 10 kHz of the resonance frequency and the skin depth may be about 0.006 mm with respect to 100 MHz of the resonance frequency.

Figure 6:
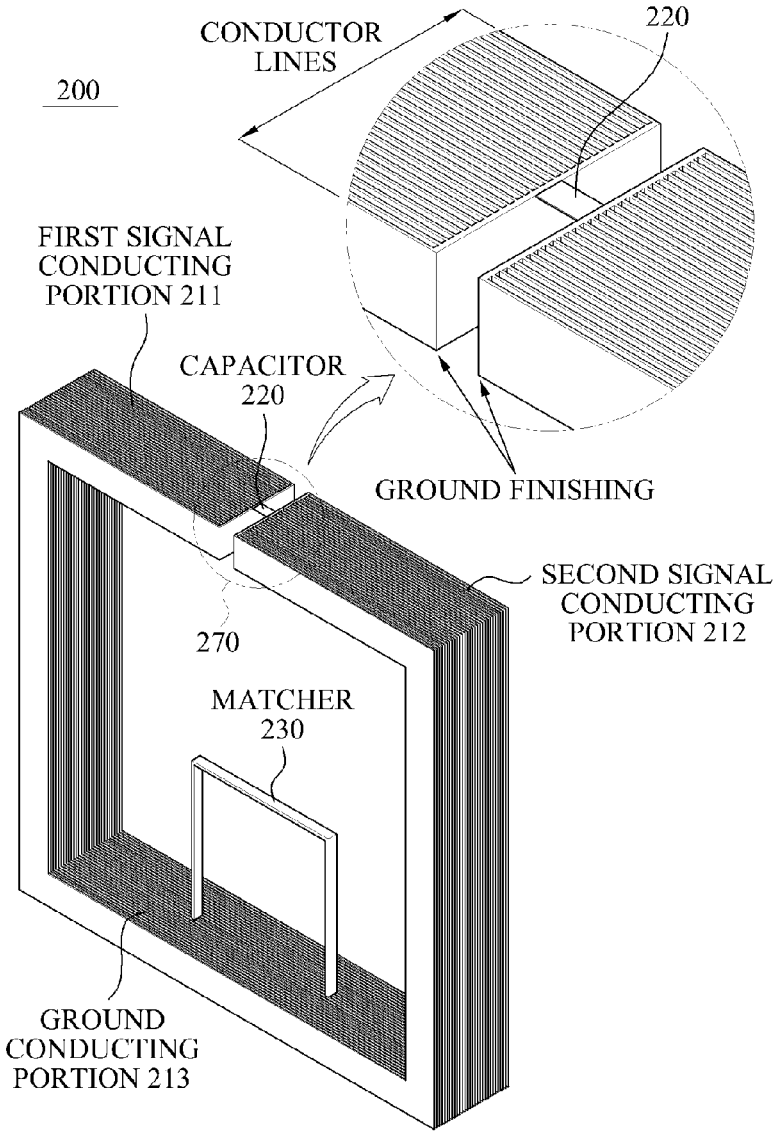
FIG. 6 is a diagram illustrating an example of a resonator for wireless power transmission using a parallel-sheet.

FIG. 6 illustrates an example of a resonator for a wireless power transmission using a parallel-sheet according to example embodiments.

Referring to FIG. 6, the parallel-sheet may be applicable to each of the first signal conducting portion 211 and the second signal conducting portion 212 included in the resonator 200.

Each of the first signal conducting portion 211 and the second signal conducting portion 212 may not be a perfect conductor and thus, may have a resistance. Due to the resistance, an ohmic loss may occur. The ohmic loss may decrease a Q-factor and also decrease a coupling effect.

By applying the parallel-sheet to each of the first signal conducting portion 211 and the second signal conducting portion 212, it is possible to decrease the ohmic loss, and to increase the Q-factor and the coupling effect. Referring to a portion 270 indicated by a circle, when the parallel-sheet is applied, each of the first signal conducting portion 211 and the second signal conducting portion 212 includes a plurality of conductor lines. The plurality of conductor lines may be disposed in parallel, and may be shorted at an end portion of each of the first signal conducting portion 211 and the second signal conducting portion 212.

As described above, when the parallel-sheet is applied to each of the first signal conducting portion 211 and the second signal conducting portion 212, the plurality of conductor lines may be disposed in parallel. Accordingly, a sum of resistances having the conductor lines may decrease. Consequently, the resistance loss may decrease, and the Q-factor and the coupling effect may increase.

Figure 7:
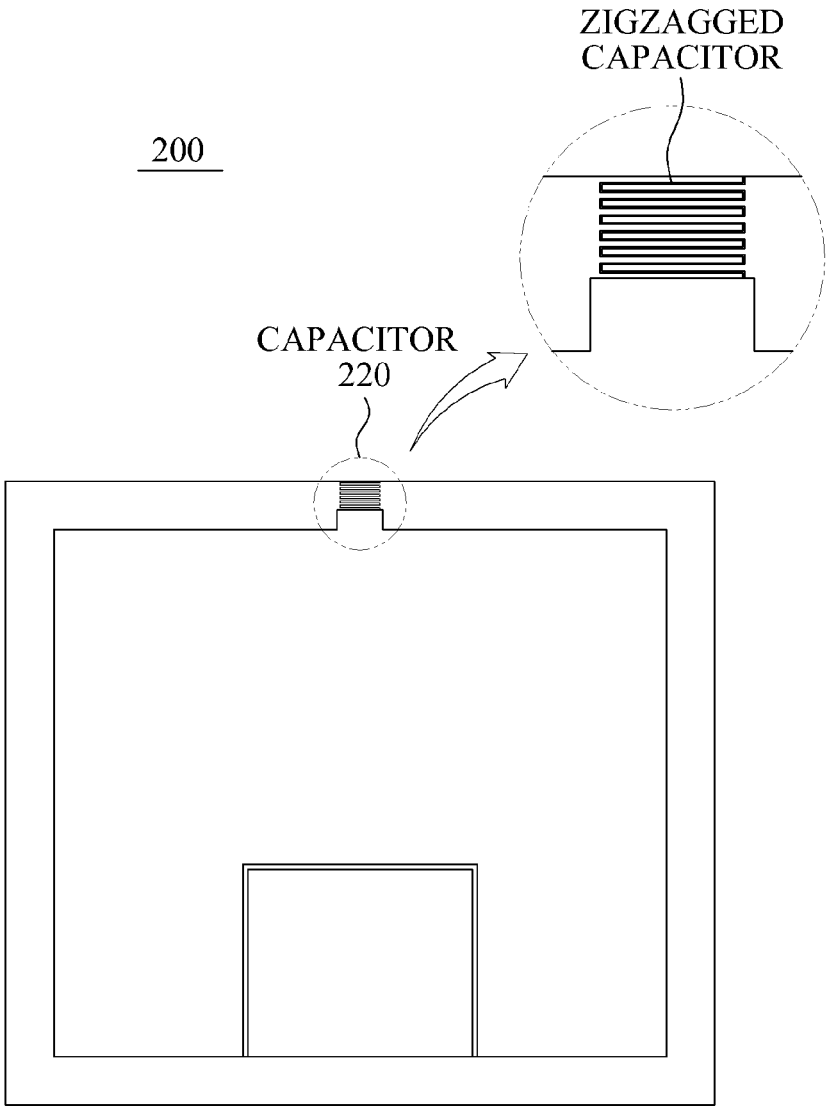
FIG. 7 is a diagram illustrating an example of a resonator for wireless power transmission, including a distributed capacitor.

FIG. 7 illustrates an example of a resonator for a wireless power transmission, including a distributed capacitor according to example embodiments.

Referring to FIG. 7, the capacitor 220 included in the resonator for the wireless power transmission may be a distributed capacitor. A capacitor as a lumped element may have a relatively high equivalent series resistance (ESR). A variety of schemes have been proposed to decrease the ESR contained in the capacitor of the lumped element. According to an embodiment, by using the capacitor 220 as a distributed element, it is possible to decrease the ESR. As is known in the art, a loss caused by the ESR may decrease a Q-factor and a coupling effect.

As shown in FIG. 7, the capacitor 220 as the distributed element may have a zigzagged structure. For example, the capacitor 220 as the distributed element may be configured as a conductive line and a conductor having the zigzagged structure.

As shown in FIG. 7, by employing the capacitor 220 as the distributed element, it is possible to decrease the loss occurring due to the ESR. In addition, by disposing a plurality of capacitors as lumped elements, it is possible to decrease the loss occurring due to the ESR. Since a resistance of each of the capacitors as the lumped elements decreases through a parallel connection, active resistances of parallel-connected capacitors as the lumped elements may also decrease whereby the loss occurring due to the ESR may decrease. For example, by employing ten capacitors of 1 pF instead of using a single capacitor of 10 pF, it is possible to decrease the loss occurring due to the ESR.

Figure 8:
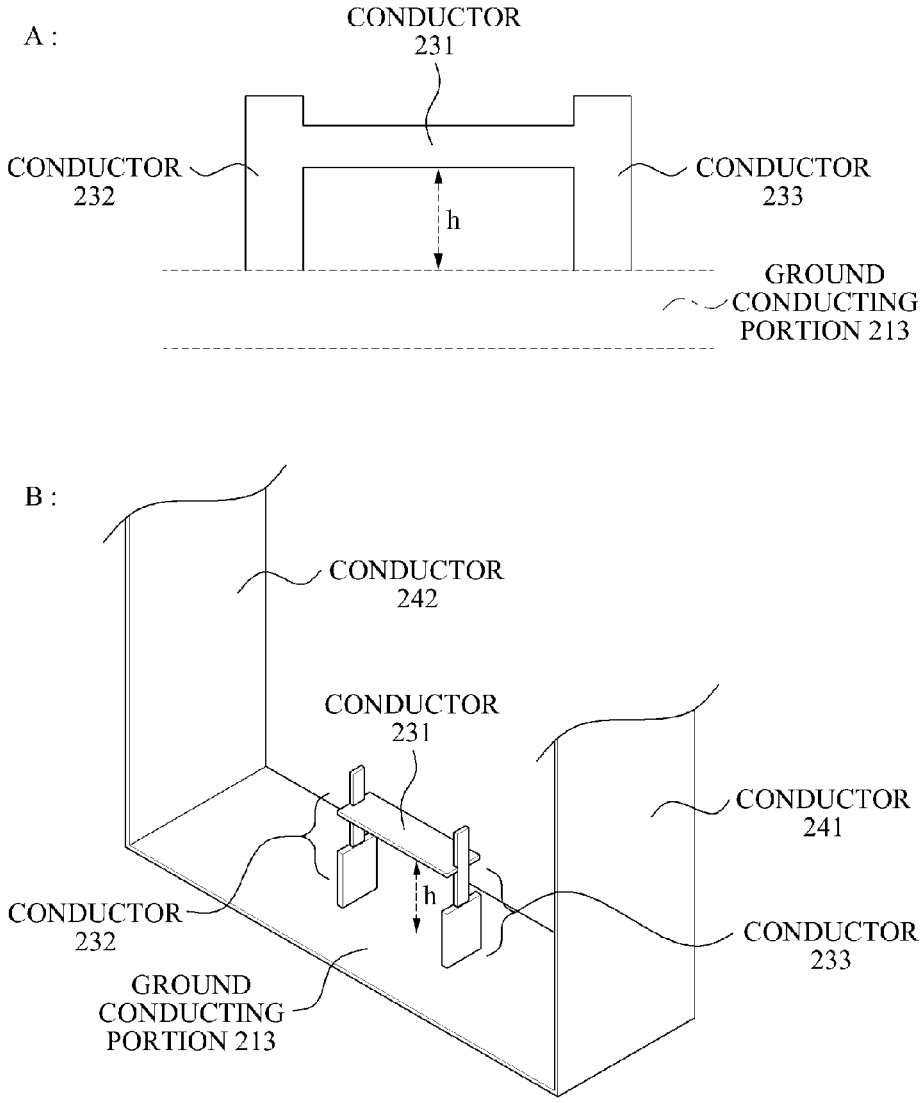
FIG. 8 are diagrams illustrating an example of a matcher used by a 2D resonator and an example of a matcher used by a 3D resonator.

FIG. 8 illustrates an example of a matcher used in a resonator provided in a 2D structure, an example of a matcher used in a resonator provided in a 3D structure.

Here, a diagram A in FIG. 8 illustrates a portion of the 2D resonator of FIG. 2 including the matcher, and a diagram B in FIG. 8 illustrates a portion of the 3D resonator of FIG. 3 including the matcher.

Referring to the diagram A in FIG. 8, the matcher includes the conductor 231, a conductor 232, and a conductor 233. The conductors 232 and 233 may be connected to the ground conducting portion 213 and the conductor 231. The impedance of the 2D resonator may be determined based on a distance h between the conductor 231 and the ground conducting portion 213. The distance h between the conductor 231 and the ground conducting portion 213 may be controlled by the controller. The distance h between the conductor 231 and the ground conducting portion 213 may be adjusted using a variety of schemes. For example, the variety of schemes may include a scheme of adjusting the distance h by adaptively activating one of conductors, for example, the conductor 231, a scheme of adjusting the physical location of the conductor 231 up and down, and the like.

Referring to the diagram B in FIG. 8, the matcher includes the conductor 231, a conductor 232, and a conductor 233. The conductors 232 and 233 may be connected to the ground conducting portion 213 and the conductor 231. The impedance of the 3D resonator may be determined based on a distance h between the conductor 231 and the ground conducting portion 213. The distance h between the conductor 231 and the ground conducting portion 213 may be controlled by the controller. Similar to the matcher included in the 2D structured resonator, in the matcher 230 included in the 3D structured resonator, the distance h between the conductor 231 and the ground conducting portion 213 may be adjusted using a variety of schemes. For example, the variety of schemes may include a scheme of adjusting the distance h by adaptively activating one of conductors, for example, the conductor 231, a scheme of adjusting the physical location of the conductor 231 up and down, and the like.

Although not illustrated in FIG. 8, the matcher may include an active element. A scheme of adjusting an impedance of a resonator using the active element may be similar as described above. For example, the impedance of the resonator may be adjusted by changing a path of a current flowing through the matcher using the active element.

Figure 9:
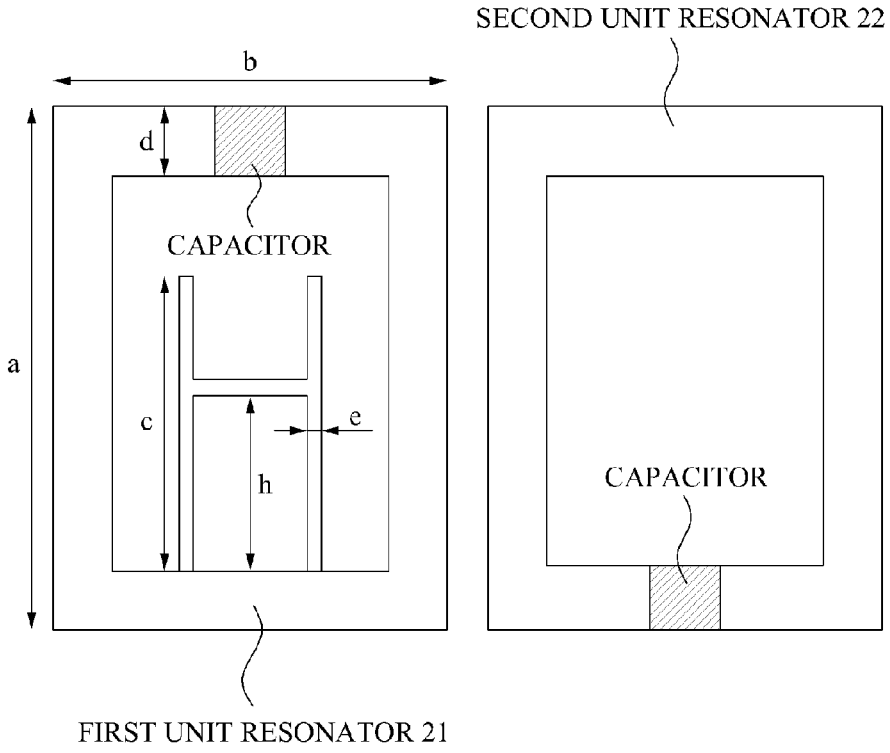
FIG. 9 is a diagram illustrating an example of a first unit resonator and a second unit resonator included in a split-ring type resonator for wireless power transmission.

FIG. 9 illustrates an example of a first unit resonator and a second unit resonator included in a split-ring type resonator for wireless power transmission.

Referring to FIG. 9, each of the first unit resonator 21 and the second unit resonator 22 included in the split-ring type resonator may include a transmission line and a capacitor inserted in series into a middle portion of the transmission line. The first unit resonator 21 may include a matcher having a thick of 'e' and a height of 'c'. The second unit resonator 22 may additionally include a matcher, although not illustrated in FIG. 9. When the second unit resonator 22 additionally includes the matcher, the matcher of the first unit resonator 21 and the matcher of the second unit resonator 22 may be connected to each other through a 'via(hole)'. In this example, when power is applied to one of the unit resonators 21 and 22, the two unit resonators 21 and 22 may operate together.

In addition, the first unit resonator 21 has a height of 'a', and a width of 'b'. The transmission line has a thickness of 'd'. The matcher has a height of 'c' and a thickness of 'e'. In this example, 'a' may be in a range from about 50 millimeters (mm) to 70 mm, 'b' may be in a range from about 30 mm to 50 mm, 'c' may be in a range from about 4 mm to 4.6 mm, 'd' may be in a range from about 4.5 mm to 5.5 mm, and 'e' may be in a range from about 1.7 mm to 2.3 mm. For example, 'a' may be 60 mm, 'b' may be 40 mm, 'c' may be 4.3 mm, 'd' may be 5 mm, and 'e' may be 2 mm. Here, 'a', 'b', 'c', 'd', and 'e' are merely examples of the size. That is, 'a' may be greater than 70 mm. A value of 'h' may be adaptively adjusted based on a desired resonant frequency, and the like.

The first unit resonator 21 and the second unit resonator 22 of FIG. 9 may be stacked in two layers, and a resonator including the first unit resonator 21 and the second unit resonator 22 in two layers may be referred to as a split-ring type resonator. For example, the first unit resonator 21 may be disposed on one plane, and the second unit resonator 22 may be disposed on another plane located at a predetermined distance away from the plane.

When an external circumference of the first unit resonator 21 of FIG. 9 is equal to an external circumference of the second unit resonator 22, and an area of an internal loop of the first unit resonator 21 is equal to an area of an internal loop of the second unit resonator 22, a mutual coupling between the first unit resonator 21 and the second unit resonator 22 may be maximized.

The capacitor of the first unit resonator 21 and the capacitor of the second unit resonator 22 may be inserted in the same direction, or in opposite directions. A case where the capacitor of the first unit resonator 21 is inserted in an opposite direction to the capacitor of the second unit resonator 22 will be described with reference to FIG. 10.

Figure 10:
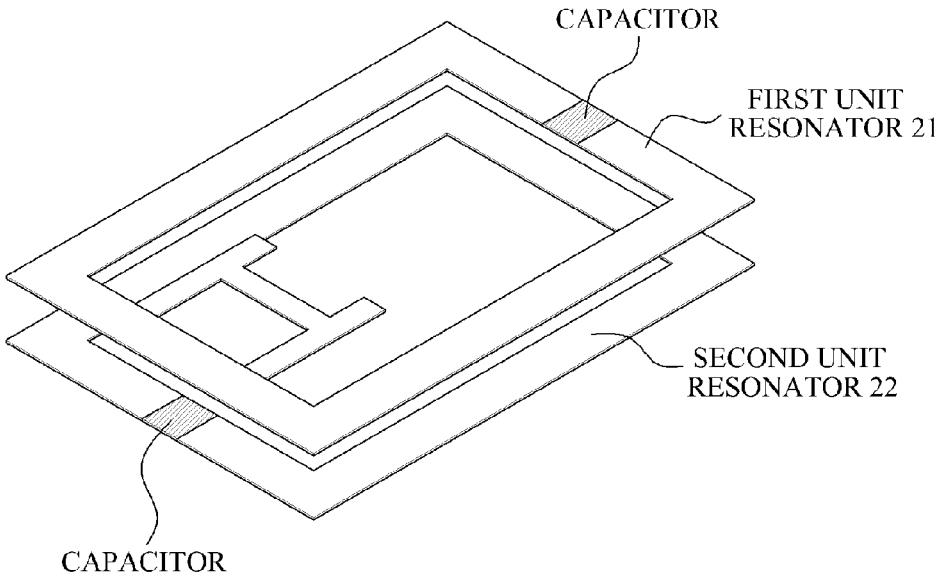
FIG. 10 is a diagram illustrating an example of a split-ring type resonator in 3D.

FIG. 10 illustrates an example of a split-ring type resonator in three-dimensions.

Referring to FIG. 10, the second unit resonator is disposed below the first unit resonator 21, and the split-ring type resonator may include the first unit resonator 21 and the second unit resonator 22 stacked in two layers.

As shown in FIG. 10, a capacitor of the first unit resonator 21 and a capacitor of the second unit resonator 22 may be inserted in opposite directions. Although not illustrated in FIG. 10, the capacitor of the first unit resonator 21 and the capacitor of the second unit resonator 22 may be inserted in the same direction.

As illustrated in FIG. 10, when an external circumference of the first unit resonator 21 is equal to an external circumference of the second unit resonator 22, and an area of an internal loop of the first unit resonator 21 is equal to an area of an internal loop of the second unit resonator 22, a mutual coupling between the first unit resonator 21 and the second unit resonator 22 may be maximized.

Figure 11:
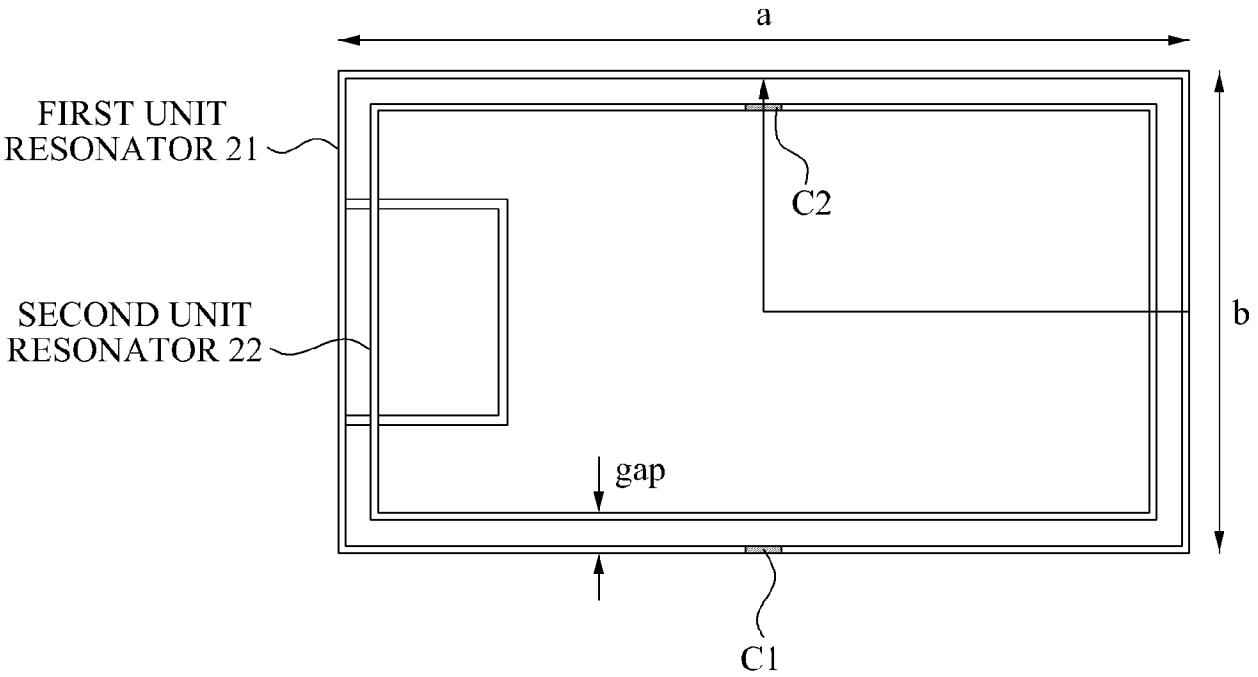
FIG. 11 is a diagram illustrating an example of a split-ring type resonator including two unit resonators having different sizes.

FIG. 11 illustrates an example of a split-ring type resonator including two unit resonators having different sizes.

Referring to FIG. 11, the split-ring type resonator may include the first unit resonator 21 and the second unit resonator 22, having different sizes from one another. That is, in the split-ring type resonator, the second unit resonator 22 may be included inside a loop of the first unit resonator 21. In this example, the first unit resonator 21 and the second unit resonator 22 may be disposed on the same plane or on different planes from one another.

In FIG. 11, C1 denotes a capacitor inserted into the first unit resonator 21 and C1 denotes a capacitor inserted into the second unit resonator 22.

Figure 12:
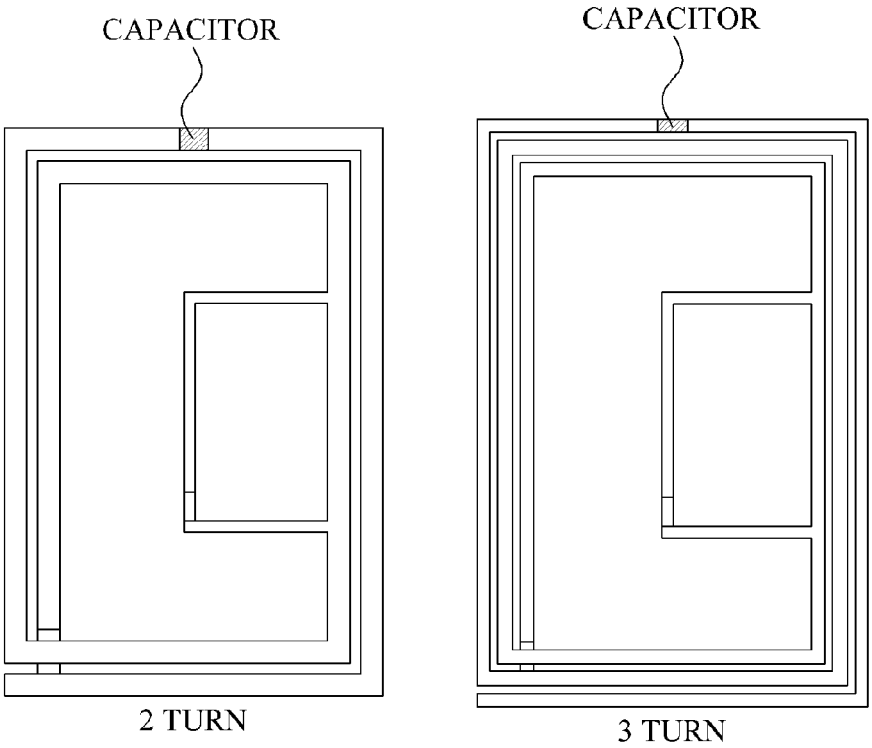
FIG. 12 is a diagram illustrating an example of a resonator for wireless power transmission, having a plurality of turns in a horizontal direction.

FIG. 12 illustrates an example of a resonator for wireless power transmission, having a plurality of turns in the horizontal direction.

Referring to FIG. 12, the resonator having the plurality of turns in the horizontal direction may include the plurality of turns formed in the horizontal direction. In particular, referring to a resonator including 2 turns in FIG. 12, conductors in an upper portion of the resonator may correspond to a first signal conducting portion and a second signal conducting portion included in a transmission line, and conductors in a lower portion of the resonator may correspond to a ground conducting portion included in the transmission line. Conductors in the left portion of the resonator may correspond to first conductors connecting the first signal conducting portion and the ground conducting portion, and conductors in the right portion of the resonator may correspond to second conductors connecting the second signal conducting portion and the ground conducting portion. In this example, the first signal conducting portion, the second signal conducting portion, the first conductor, and the second conductor may include the 2 turns. In this manner, referring to a resonator including 3 turns in FIG. 12, a first signal conducting portion, a second signal conducting portion, a first conductor, and a second conductor included in the resonator may include the 3 turns. Here, sizes of turns may be the same or may be different from each other.

Since the plurality of turns is formed on substantially the same plane, the turns may be regarded to be formed in the horizontal direction. An inductance value of the resonator may increase due to the plurality of turns formed in the horizontal direction. Accordingly, a capacitance of a capacitor with respect to the inductance may be relatively decreased. Therefore, an effect of an ESR may be decreased, and the resonator for wireless power transmission, having the plurality of turns, may be applicable to a mobile device, for example, a portable phone.

Figure 13:
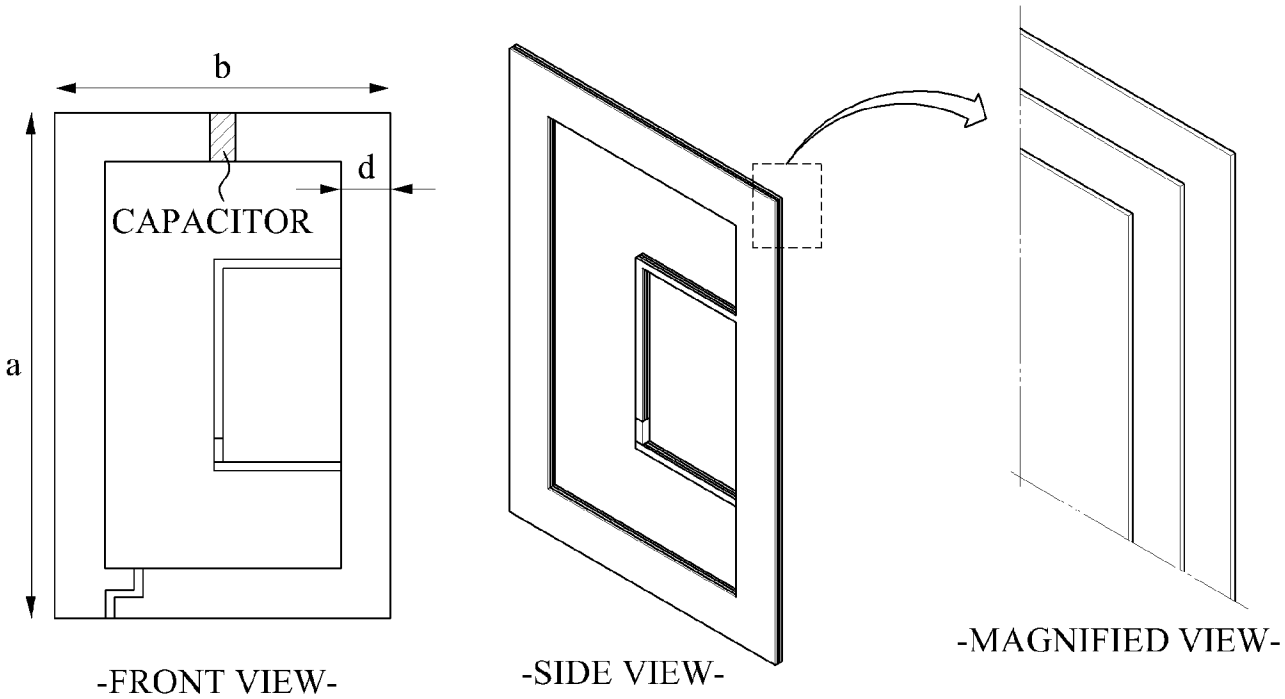
FIG. 13 is a diagram illustrating an example of a resonator for wireless power transmission, having a plurality of turns in a vertical direction.

FIG. 13 illustrates an example of a resonator for wireless power transmission, having a plurality of turns in the vertical direction.

Referring to a front view of the resonator in FIG. 13, the resonator having the plurality of turns in the vertical direction may include the resonator of FIG. 2. Referring to a side view of the resonator in FIG. 13, the plurality of turns is formed in the vertical direction. Here, the plurality of turns may be electrically connected.

Referring to FIG. 13, the plurality of turns may exist in different planes, respectively. In this example, sizes of the turns may be the same or may be different from each other. Since the plurality of turns exists in different planes, the plurality of turns may be regarded to be formed in the vertical direction. The resonator having the plurality of turns may be in a 3-layered structure. Due to the 3-layered structure, inductance with respect to a given sectional area may increase, and a capacitance of a capacitor may be relatively reduced. Accordingly, the resonator may be less affected by an ESR, and well may be applicable to a mobile device, for example, a portable phone. In addition, the resonator of FIG. 13 may minimize an effect to an ambient environment, when compared to the resonator of FIG. 12, having the plurality of turns in the horizontal direction.

Based on the concept of a parallel-sheet, the plurality of turns in FIG. 12 and FIG. 13 may be shorted to a single ground plane. In this example, when the plurality of turns illustrated in FIGS. 12 and 13 are shorted to one ground plane, a resistance loss may be minimized and thus, a Q factor may be improved.

Figure 14:
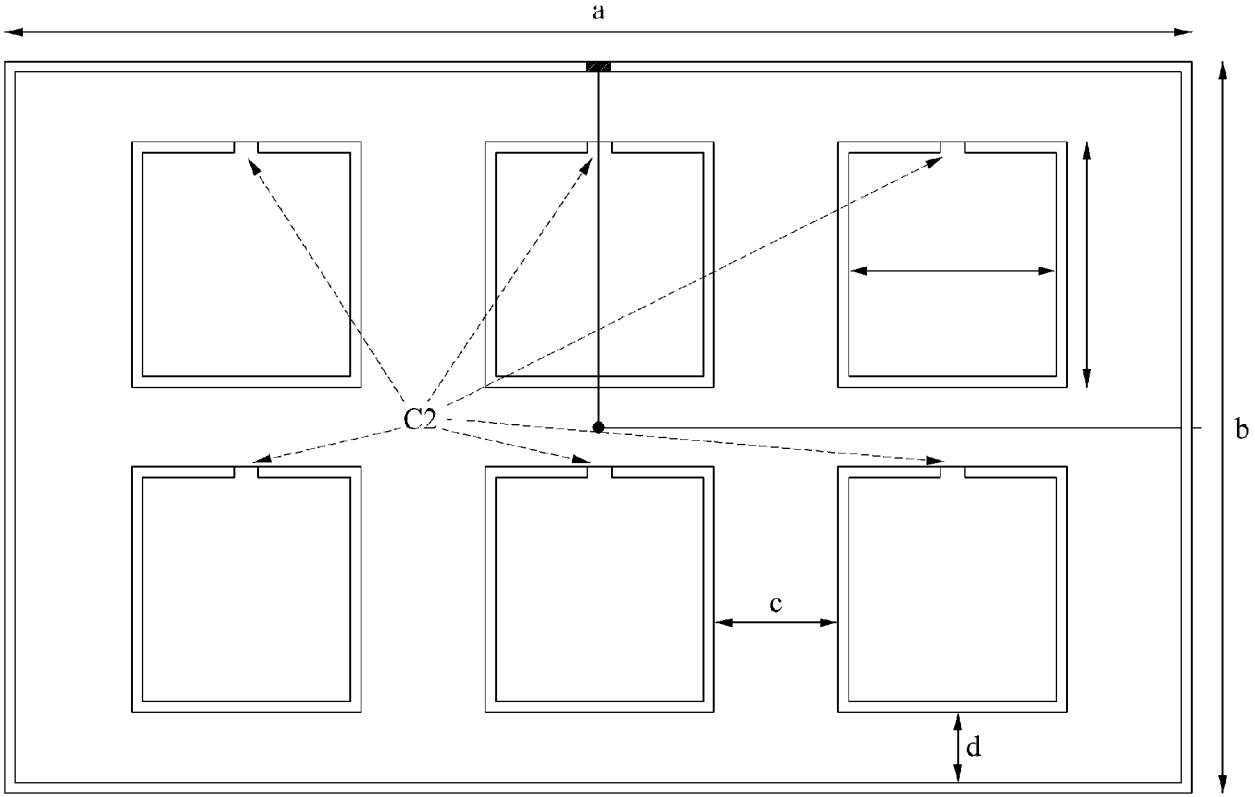
FIG. 14 is a diagram illustrating an example of a resonator for wireless power transmission, including a relatively large unit resonator and relatively small unit resonators disposed inside a loop of the relatively large unit resonator.

FIG. 14 illustrates an example of a resonator for wireless power transmission, including a relatively large unit resonator and relatively small unit resonators disposed inside a loop of the relatively large unit resonator.

Referring to FIG. 14, the resonator for wireless power transmission may include a first unit resonator having a width of 'a' and a height of b', and six second unit resonators which are smaller than the first unit resonator. Here, a number of second unit resonators may be variable. The six second unit resonators may be located inside a loop of the first unit resonator, and may be disposed inside the loop of the first unit resonator at regular intervals. Here, 'a' may be about 260 mm, 'b' may be about 150 mm, 'c' may be about 27.5 mm, and 'd' may be about 16.7 mm.

The resonator of FIG. 14 may have a high effective magnetic permeability (mu), and may increase a power transmission gain. The second unit resonator may perform a function of effectively increasing the mu of the resonator and thus, the overall value of mu for the resonator may increase. Referring to the resonator of FIG. 14, mu may be improved based on an alignment of the first unit resonator and the second unit resonators, as opposed to based on a material.

Figure 15:
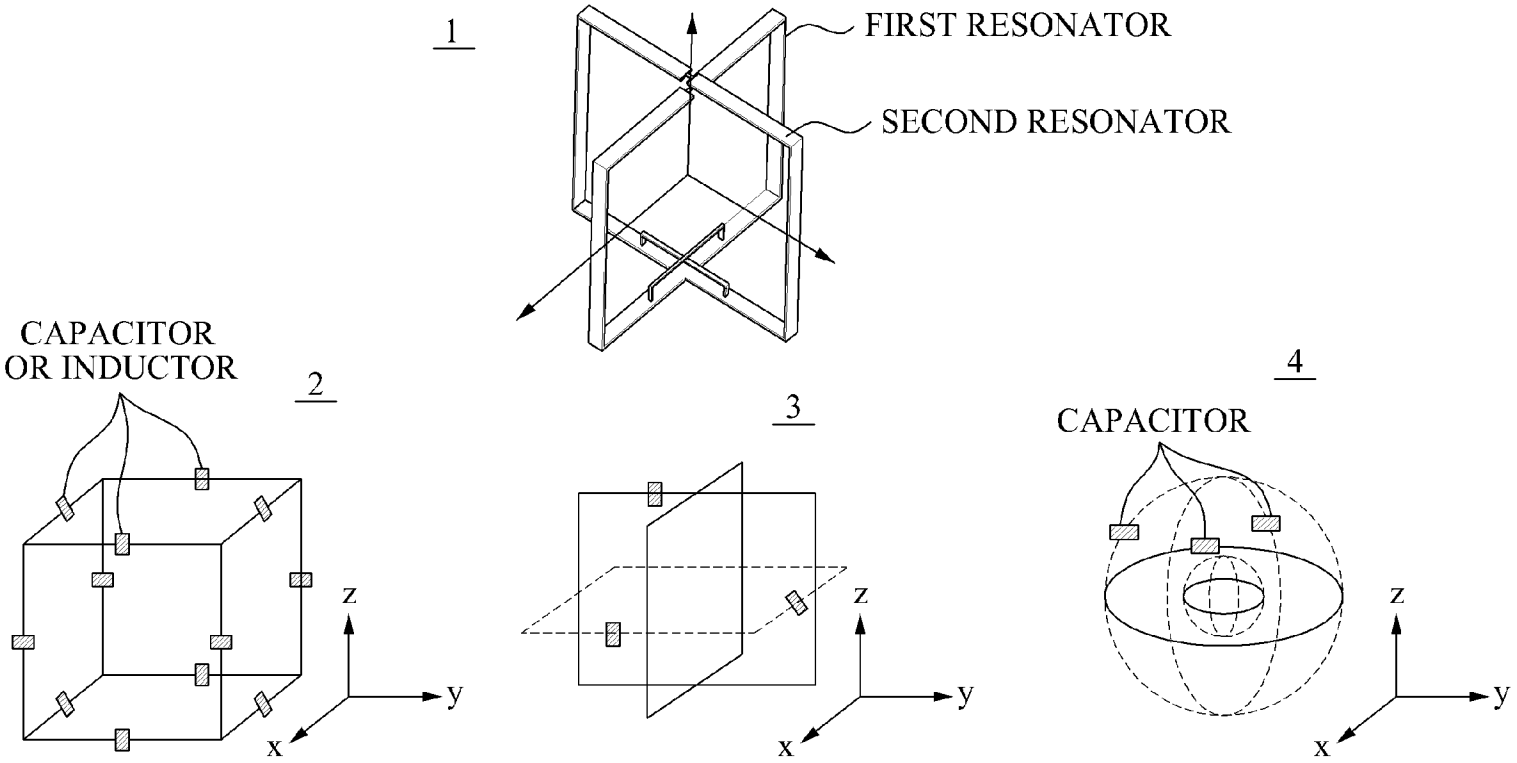
FIG. 15 is a diagram illustrating an example of a 3D resonator for wireless power transmission, having an omni-directional characteristic.

FIG. 15 illustrates an example of a 3D resonator for wireless power transmission, having an omni-directional characteristic.

Referring to resonator 1 of FIG. 15, a magnetic field by a first unit resonator and a magnetic field by a second unit resonator may be generated in different directions. In particular, the magnetic field by the first unit resonator and the magnetic field by the second unit resonator may be orthogonal to each other and thus, the magnetic fields may not be coupled to one another. Accordingly, resonator 1 of FIG. 15 may perform omni-directional power transmission.

Referring to resonator 2 of FIG. 15, six surfaces included in a regular hexahedron may correspond to unit resonators, respectively. Resonator 2 of FIG. 15 may perform omni-directional power transmission, and may adaptively adjust a strength of the magnetic field.

A resonator according to example embodiments may have a structure of resonator 3 of FIG. 15, and the resonator may perform omni-directional power transmission.

The resonator according to example embodiments may have a spheral structure, for example, resonator 4 of FIG. 15. Referring to resonator 4 of FIG. 15, an external side of the sphere may be enclosed by transmission lines, a cross feeder may be disposed inside the sphere. The cross feeder may include feeders, and power may be transmitted in a direction corresponding to an activated feeder among the feeders. In particular, when all the feeders are activated, power may be transmitted in omni-directions.

Figure 16:
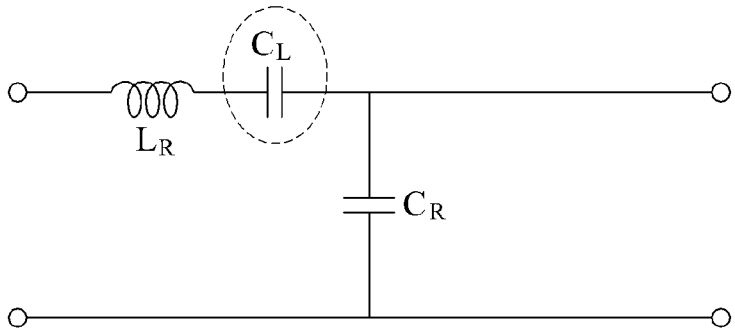
FIG. 16 is a diagram illustrating an example of an equivalent circuit of a resonator for wireless power transmission of FIG. 2.

FIG. 16 illustrates an example of an equivalent circuit of a resonator for wireless power transmission of FIG. 2.

The resonator for wireless power transmission in FIG. 2 may be modeled to be an equivalent circuit of FIG. 16. In the equivalent circuit of FIG. 16, CL denotes a capacitor inserted, in a form of lumped elements, into a middle portion of the transmission line of FIG. 2.

In this example, the resonator for wireless power transmission in FIG. 2 may have a zeroth-order resonance characteristic. That is, when a propagation constant is '0', the resonator for wireless power transmission may have a resonant frequency of $\omega_{MZR}$. In this example, $\omega_{MZR}$ may be expressed by Equation 1. Here, MZR may denote a Mu zero resonator.

$$\omega_{MZR} = \frac{1}{\sqrt{L_R C_L}} \quad \text{[Equation 1]}$$

Referring to Equation 1, $\omega_{MZR}$ that is, the resonant frequency of the resonator, may be determined based on $$L_R / C_L,$$

and may $\omega_{MZR}$ be independent of a physical size of the resonator. Accordingly, the physical size of the resonator is independent of $\omega_{MZR}$ and thus, the physical size of the resonator may be sufficiently reduced.

Figure 17:
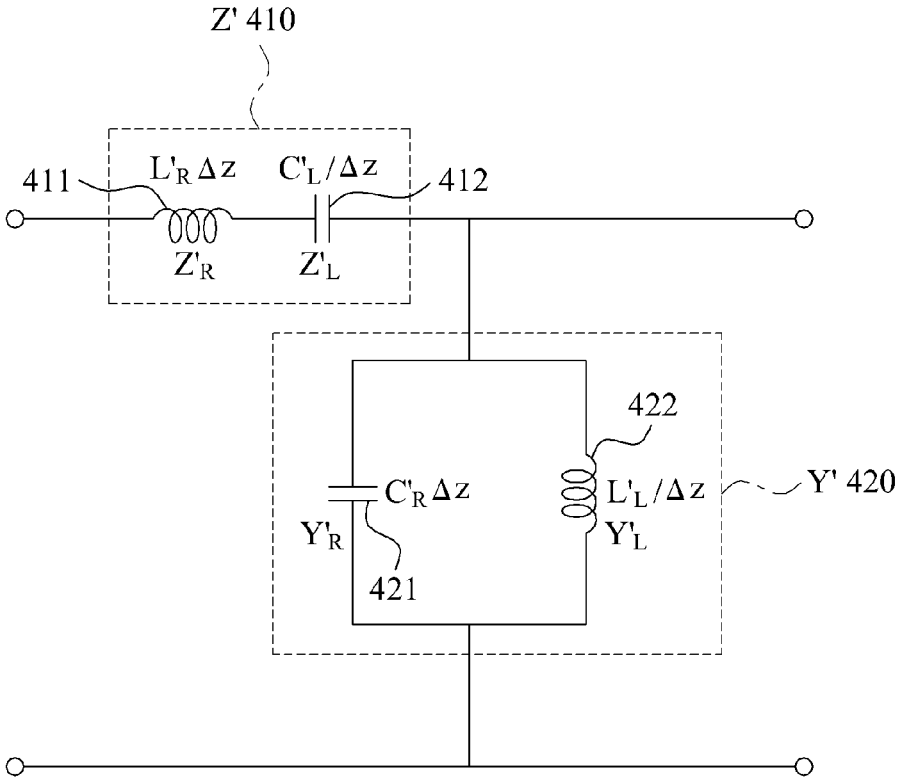
FIG. 17 is a diagram illustrating an example of an equivalent circuit of a composite right-left handed transmission line having a zeroth-order resonance characteristic.

FIG. 17 illustrates an example of an equivalent circuit of a composite right-left handed transmission line having a zeroth-order resonance characteristic. Although the resonator for wireless power transmission is based on an MNG transmission line, the MNG transmission line will be described using the composite right-left handed transmission line.

Referring to FIG. 17, an equivalent circuit of the composite right-left handed transmission line may include a basic transmission line, and may additionally include $$C'_L / \Delta z$$

412 that is a series-capacitor, and $$L'_L / \Delta z$$

422 that is shunt-inductor. Here, $$L'_R / \Delta z$$

411 and $$C'_R / \Delta z$$

421 may denote an inductor component and a capacitor component of the basic transmission line, respectively.

In this example, impedance Z' 410 may be a sum of a component corresponding to $$L'_R / \Delta z$$

411 and a component corresponding to $$C'_L / \Delta z$$

412, and admittance Y' 420 may be a sum of a component corresponding to $$C'_R / \Delta z$$

421 and a component corresponding to $$L'_L / \Delta z$$

422.

Accordingly, impedance Z' 410 and admittance Y 420 may be expressed by Equation 2.

$$Z' = j\left(\omega L'_R - \frac{1}{\omega C'_L}\right) \quad \text{[Equation 2]}$$

$$Y' = j\left(\omega C'_R - \frac{1}{\omega L'_L}\right)$$

Referring to Equation 2, a resonant frequency, at which an amplitude of impedance Z 410 or admittance Y' 420 is minimized, may be adjusted by appropriately adding $$C'_L/\Delta z$$

412 and $$L'_L/\Delta z$$

422 to the transmission line. Also, the composite right-left handed transmission line has a zeroth-order resonance characteristic. That is, a resonant frequency of the composite right-left handed transmission line may be a frequency when a propagation constant is '0'.

When only $$C'_L/\Delta z$$

412 is added to the basic transmission line, the transmission line may have a negative value of mu in a predetermined frequency band and thus, may be referred to as an MNG transmission line.

Also, when only $$L'_L/\Delta z$$

422 is added to the basic transmission line, the transmission line may have a negative permeability and thus, may be referred to as an ENG transmission line. The MNG transmission line and the ENG transmission line may also have a zeroth-order resonance characteristic.

A MNG resonator according to example embodiments may include $$C'_L/\Delta z$$

412 so that a magnetic field is dominant in a near field. That is, an electric field is concentrated on $$C'_L/\Delta z$$

412 in the near field and thus, the magnetic field may be dominant in the near field.

Also, the MNG resonator may have a zeroth-order resonance characteristic in the same manner as the composite right-left handed transmission line and thus, the MNG resonator may be manufactured to be small, irrespective of the resonant frequency.

Figures 18, 19:
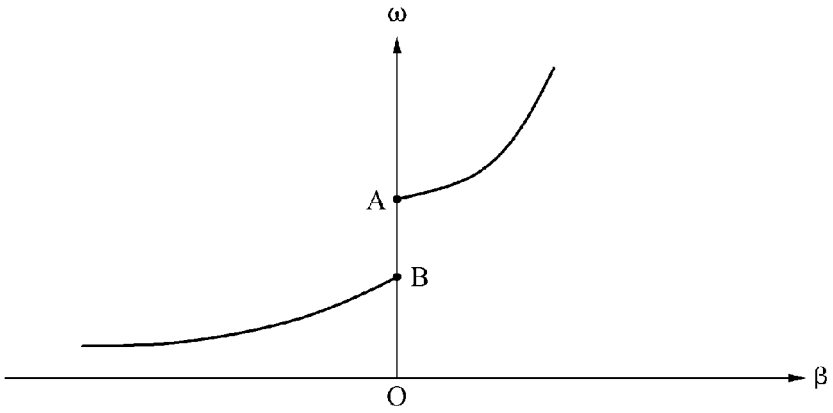
FIG. 18 is a graph illustrating a zeroth-order resonance generated from a composite right-left handed transmission line.
FIG. 19 is a table illustrating an example of characteristics of a resonator for wireless power transmission.

FIG. 18 is a graph illustrating a zeroth-order resonance generated from a composite right-left handed transmission line.

Referring to FIG. 18, the composite right-left handed transmission line may have a resonant frequency of A and a resonant frequency of B. In this example, a propagation constant (β) corresponding to A and B is '0' and thus, the composite right-left handed transmission line may have the zeroth-order resonance characteristic.

Similar to the composite right-left handed transmission line, an MNG transmission line and an ENG transmission line may also have the zeroth-order resonance characteristic. For example, a resonant frequency of the MNG transmission line may be A, and a resonant frequency of the ENG transmission line may be B. Accordingly, the MNG resonator may be manufactured to have a sufficiently small size.

FIG. 19 is a table illustrating characteristics of a resonator for wireless power transmission.

Referring to FIG. 19, a magnetic field is more dominant than an electric field in a near field of an MNG resonator. Also, the MNG resonator may improve a power transmission efficiency through a magnetic field coupling.

The MNG resonator may be manufactured in a 3D structure, and may aim for a high Q factor. The MNG resonator may be used for wireless power transmission in a short distance.

Figure 20:
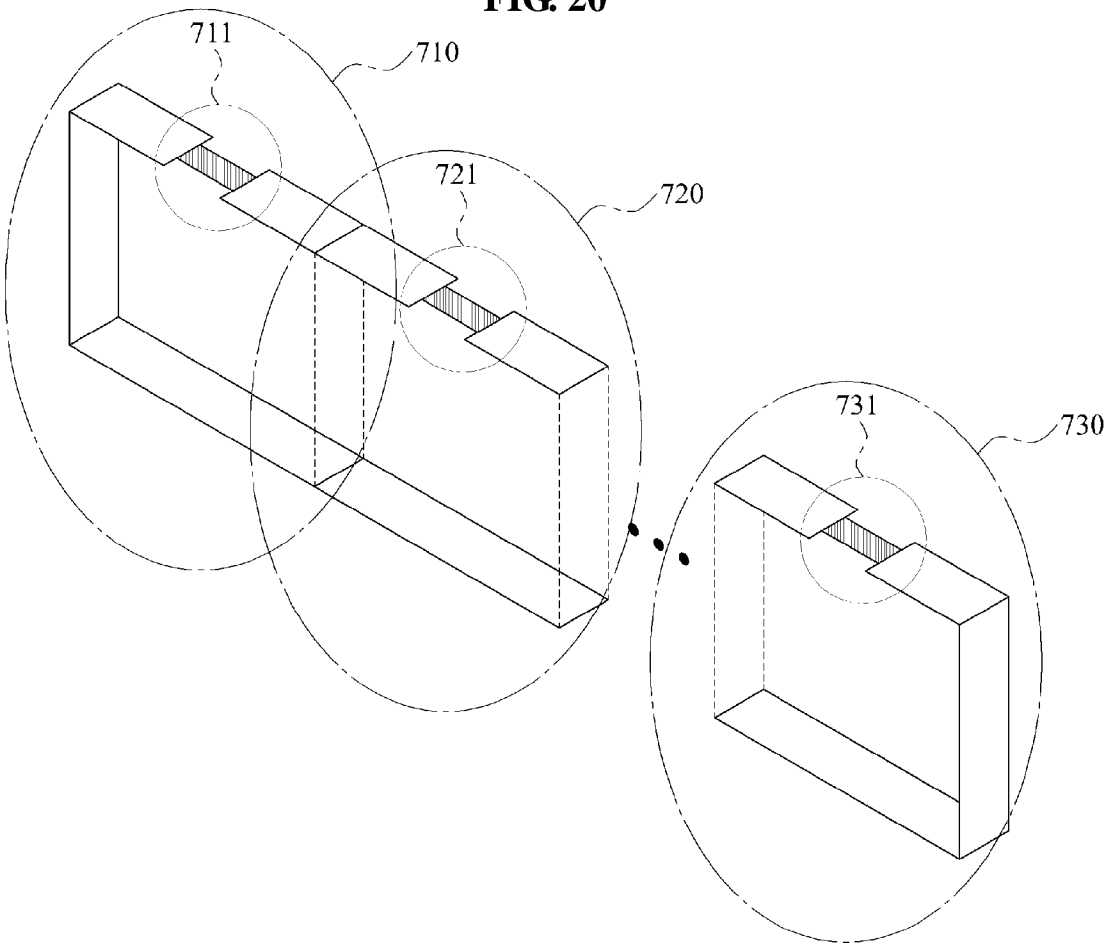
FIGS. 20 through 22 are diagrams illustrating examples of a resonator for wireless power transmission.
Figure 21:
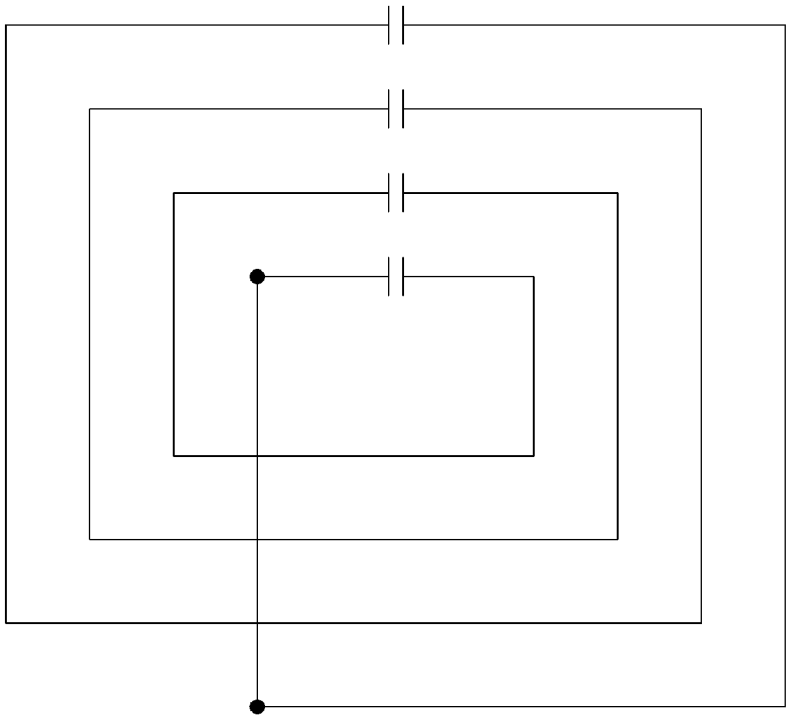
Figure 22:
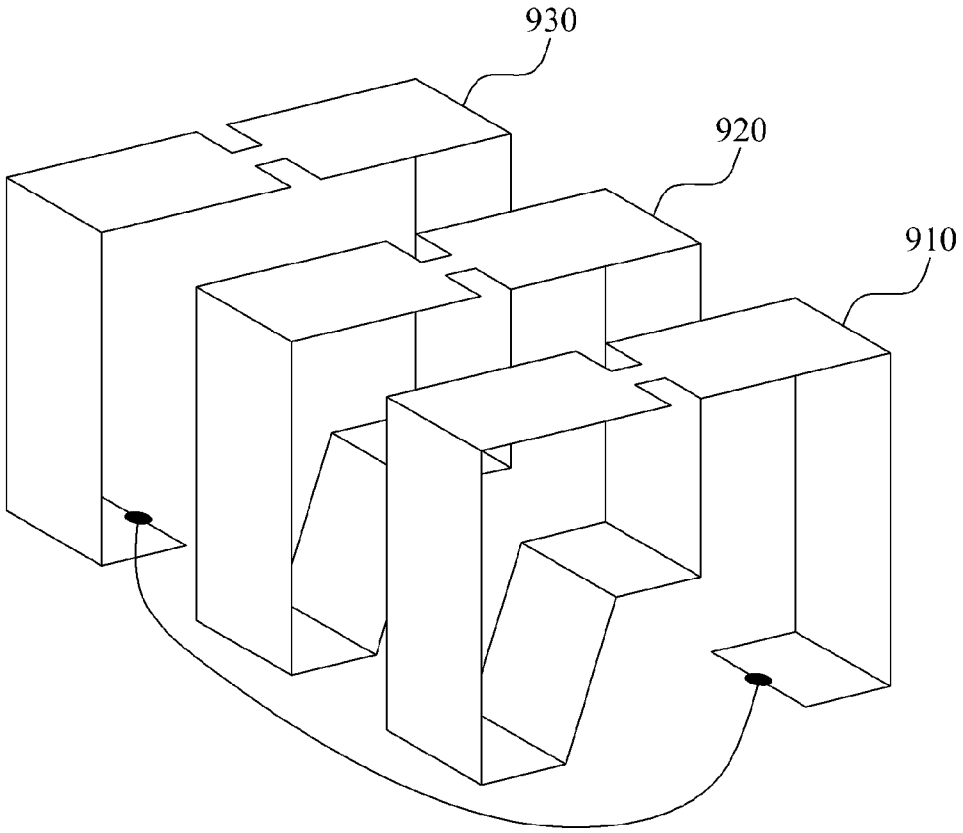

FIGS. 20 through 22 illustrate examples of a resonator for wireless power transmission.

Referring to FIG. 20, the resonator for wireless power transmission may include a plurality of transmission lines 710, 720, and 730 which are connected in series. In this example, a plurality of capacitors 711, 721, 731 may be inserted into the plurality of transmission lines 710, 720, and 730, respectively.

Referring to FIG. 21, the resonator for wireless power transmission may have a spiral structure. That is, a plurality of transmission lines may be connected to each other so as to be configured as the spiral structure, and a plurality of capacitors may be inserted into the plurality of transmission lines, respectively.

Referring to FIG. 22, the resonator for wireless power transmission may include a plurality of transmission lines 910, 920, and 930 which are connected to each other in parallel.

In addition to examples of FIG. 20 through 22, the resonator may be manufactured in various shapes.

Figure 23:
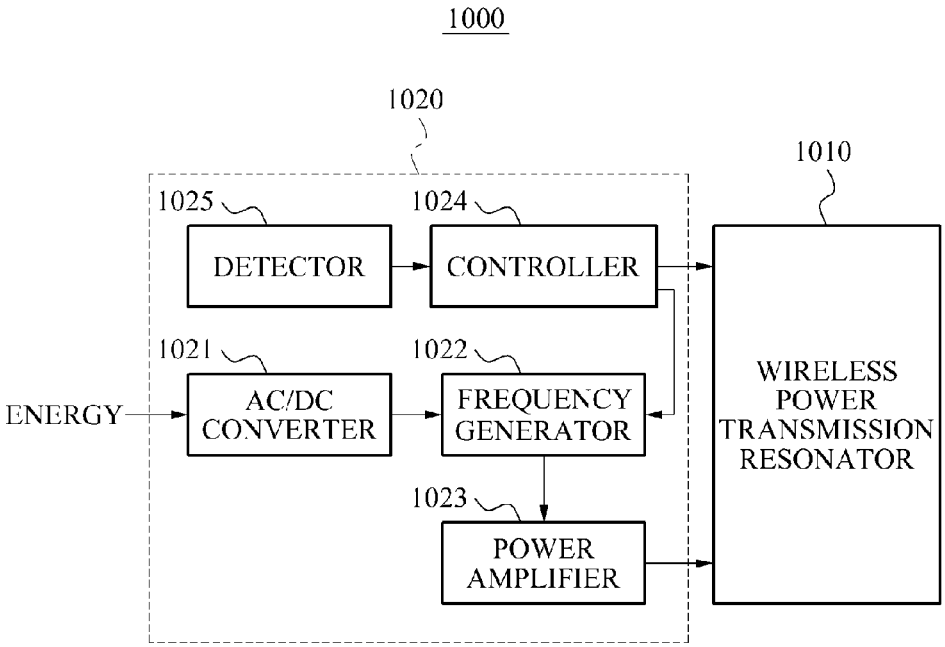
FIG. 23 is a block diagram illustrating an example of a wireless power transmitter that is applicable to a source of FIG. 1.

FIG. 23 illustrates a configuration of a wireless power transmitter that is applicable to a source of FIG. 1.

Referring to FIG. 23, a wireless power transmitter 1000 may include a resonator 1010 and a pre-processor 1020.

A wireless power transmission resonator 1010 may be a resonator described with respect to FIGS. 1 through 22, and power may be wirelessly transmitted using a wave propagated by the wireless power transmission resonator 1010.

The pre-processor 1020 may generate a current and a frequency for wireless power transmission, using energy supplied from a power supplier existing inside or outside the wireless power transmitter 1000.

In particular, the pre-processor 1020 may include an alternating current/direct current (AC/DC) converter 1021, a frequency generator 1022, a power amplifier 1023, a controller 1024, and a detector 1025.

The AC/DC converter 1021 may convert AC energy supplied from the power supplier into DC energy or a DC current. In this example, the frequency generator 1022 may generate a desire frequency, that is, a desired resonant frequency, based on the DC energy or the DC current, and may generate a current having the desired frequency. The current having the desired frequency may be amplified by the power amplifier 1023.

The controller 1024 may generate a control signal to control an impedance of the wireless power transmission resonator 1010, and may adjust a frequency generated by the frequency generator 1022. For example, an optimal frequency, at which a power transmission gain, a coupling efficiency, and the like are maximized, may be selected from among frequency bands.

The detector 1025 may detect a distance between the wireless power transmission resonator 1010 and a wireless power reception resonator of a wireless power receiver, a reflection coefficient of a wave radiated from the wireless power transmission resonator 1010 to the wireless power reception resonator, a power transmission gain between the wireless power transmission resonator 1010 and the wireless power reception resonator, a coupling efficiency between the wireless power transmission resonator 1010 and the wireless power reception resonator, or the like.

In this example, the controller 1024 may generate a control signal that adjusts an impedance of the wireless power transmission resonator 1010 based on the distance, the reflection coefficient, the power transmission gain, the coupling efficiency, and the like, or that controls a frequency generated by the frequency generator 1022.

Figure 24:
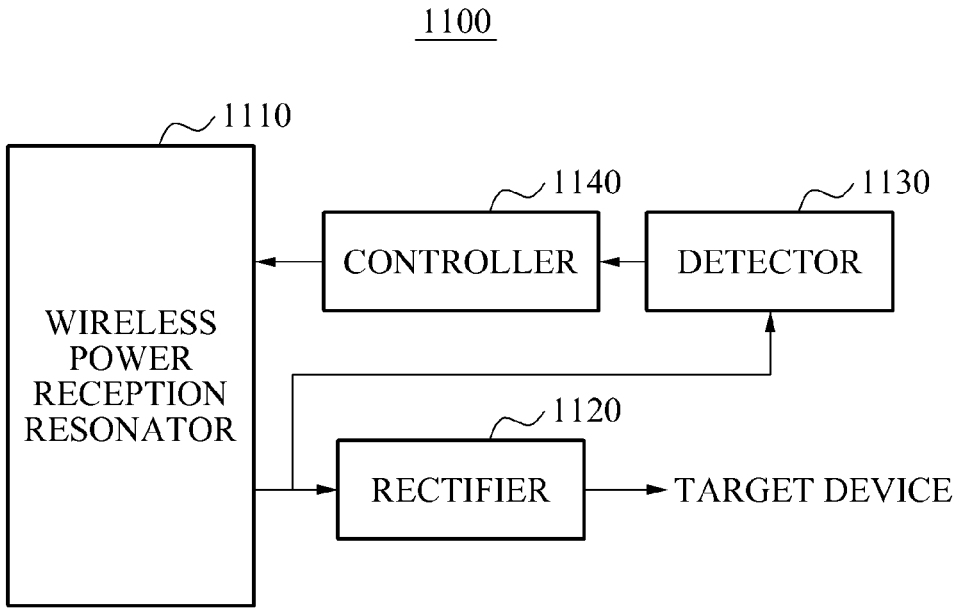
FIG. 24 is a block diagram illustrating an example of a wireless power receiver that is applicable to a destination of FIG. 1.

FIG. 24 illustrates a configuration of a wireless power receiver that is applicable to a destination of FIG. 1.

Referring to FIG. 24, a wireless power receiver 1100 may include a wireless power reception resonator 1110, a rectifier 1120, a detector 1130, and a controller 1140.

The wireless power reception resonator 1110 may be a resonator described with reference to FIGS. 1 through 22, and may receive a wave propagated by a wireless power transmitter.

The rectifier 1120 may convert power received by the wave into DC energy, and all or a portion of the DC energy may be provided to a target device.

The detector 1130 may detect a distance between the wireless power transmission resonator and the wireless power reception resonator 1110 of the wireless power receiver 1100, a reflection coefficient of a wave radiated from the wireless power transmission resonator to the wireless power reception resonator 1100, a power transmission gain between the wireless power transmission resonator and the wireless power reception resonator 1100, a coupling efficiency between the wireless power transmission resonator and the wireless power reception resonator 1100, or the like.

The controller 1140 may generate a control signal to control an impedance of the wireless power reception resonator 1100 based on the distance between the wireless power transmission resonator and the wireless power reception resonator 1110 of the wireless power receiver 1100, the reflection coefficient of a wave radiated from the wireless power transmission resonator to the wireless power reception resonator 1100, the power transmission gain between the wireless power transmission resonator and the wireless power reception resonator 1100, the coupling efficiency between the wireless power transmission resonator and the wireless power reception resonator 1100, or the like.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. A wireless power resonator, comprising:

at least two unit resonators, wherein each unit resonator comprises:

a transmission line including a first signal conducting portion, a second signal conducting portion, and a ground conducting portion corresponding to the first signal conducting portion and the second signal conducting portion;

a first conductor that electrically connects the first signal conducting portion and the ground conducting portion;

a second conductor that electrically connects the second signal conducting portion and the ground conducting portion; and at least one capacitor inserted between the first signal conducting portion and the second signal conducting portion in series with respect to a current flowing through the first signal conducting portion and the second signal conducting portion.

2. The wireless power resonator of claim 1, wherein the transmission line, the first conductor, the second conductor form a loop structure.

3. The wireless power resonator of claim 1, wherein the at least two unit resonators comprise a first unit resonator and a second unit resonator, the first unit resonator is disposed on an upper plane and the second unit resonator is disposed on a lower plane, and the upper plane and the lower plane are disposed at a predetermined distance away from each other.

4. The wireless power resonator of claim 3, wherein an external circumference of the first unit resonator is equal to an external circumference of the second unit resonator, and an area of an internal loop of the first unit resonator is equal to an area of an internal loop of the second unit resonator.

5. The wireless power resonator of claim 3, wherein a capacitor inserted into the first unit resonator is disposed in an opposite direction to a direction in which a capacitor inserted into the second unit resonator is disposed.

6. The wireless power resonator of claim 3, wherein the second unit resonator is included in a loop of the first unit resonator.

7. The wireless power resonator of claim 1, further comprising:

a matcher, disposed inside a loop formed by the transmission line, the first conductor, and the second conductor, to determine an impedance of the wireless power resonator.

8. A wireless power resonator, comprising:

a transmission line comprising a first signal conducting portion, a second signal conducting portion, a ground conducting portion corresponding to the first signal conducting portion and the second signal conducting portion;

a first conductor that electrically connects the first signal conducting portion and the ground conducting portion;

a second conductor that electrically connects the second signal conducting portion and the ground conducting portion; and at least one capacitor inserted between the first signal conducting portion and the second signal conducting portion in series with respect to a current flowing through the first signal conducting portion and the second signal conducting portion, wherein the first signal conducting portion, the second signal conducting portion, the first conductor, and the second conductor form a plurality of turns.

9. The wireless power resonator of claim 8, wherein the plurality of turns included in at least one transmission line is disposed in the same plane.

10. The wireless power resonator of claim 8, further comprising:

a matcher, disposed inside a loop formed by the transmission line, the first conductor, and the second conductor.

11. A wireless power resonator, comprising:

a first unit resonator and at least one second unit resonator having a size less than a size of the first unit resonator, wherein:

each resonance unit comprises:

a transmission line comprising a first signal conducting portion, a second signal conducting portion, and a ground conducting portion corresponding to the first signal conducting portion and the second signal conducting portion;

a first conductor that electrically connects the first signal conducting portion and the ground conducting portion;

a second conductor that electrically connects the second signal conducting portion and the ground conducting portion; and at least one capacitor inserted between the first signal conducting portion and the second signal conducting portion in series with respect to a current flowing through the first signal conducting portion and the second signal conducting portion, and the at least one second unit resonator is disposed inside a loop of the first unit resonator.

12. The wireless power resonator of claim 11, wherein the at least one second unit resonator is disposed inside the loop of the first unit resonator at regular intervals.

13. The wireless power resonator of claim 12, wherein each unit resonator further comprises a matcher that is disposed inside the loop formed by the transmission line, the first conductor, and the second conductor so as to determine an impedance of the wireless power resonator.

14. A wireless power resonator, comprising:

at least two unit resonators forming magnetic fields in different directions, wherein each unit resonator comprises:

a transmission line comprising a first signal conducting portion, a second signal conducting portion, and a ground conducting portion corresponding to the first signal conducting portion and the second signal conducting portion;

a first conductor that electrically connects the first signal conducting portion and the ground conducting portion;

a second conductor that electrically connects the second signal conducting portion and the ground conducting portion; and at least one capacitor inserted between the first signal conducting portion and the second signal conducting portion in series with respect to a current flowing through the first signal conducting portion and the second signal conducting portion.

15. The wireless power resonator of claim 14, wherein the at least two unit resonators are disposed to enable magnetic fields formed by the at least two unit resonators to be orthogonal to each other.

16. The wireless power resonator of claim 14, wherein the current flows through at least one resonator selected from among the at least two unit resonators.

* * * * *